US006935461B2

(12) United States Patent
Marocco

(10) Patent No.: US 6,935,461 B2
(45) Date of Patent: Aug. 30, 2005

(54) EXHAUST SOUND AND EMISSION CONTROL SYSTEMS

(76) Inventor: Gregory M. Marocco, 49 Stoney Brook Rd., Montville, NJ (US) 07045

( * ) Notice: Subject to any disclaimer, the term of this patent is extended or adjusted under 35 U.S.C. 154(b) by 0 days.

(21) Appl. No.: 10/663,751

(22) Filed: Sep. 17, 2003

(65) Prior Publication Data

US 2004/0050618 A1 Mar. 18, 2004

Related U.S. Application Data

(63) Continuation-in-part of application No. 09/135,804, filed on Aug. 18, 1998, and a continuation-in-part of application No. 10/252,506, filed on Sep. 24, 2002, now Pat. No. 6,651,773.

(51) Int. Cl.[7] ..... F01N 1/08; F01N 7/00

(52) U.S. Cl. ..... 181/270; 181/212; 181/275

(58) Field of Search ..... 181/275, 270, 181/268, 252, 222, 251, 249, 256, 257, 212; 60/295, 309

(56) References Cited

U.S. PATENT DOCUMENTS

| | | | | |
|---|---|---|---|---|
| 2,573,474 A | | 4/1951 | Marx | |
| 3,061,416 A | | 10/1962 | Kazokas | |
| 3,201,338 A | | 8/1965 | Pennington | |
| 4,032,310 A | | 6/1977 | Ignoffo | |
| 4,050,903 A | | 9/1977 | Bailey et al. | |
| 4,164,267 A | * | 8/1979 | Meineke et al. | 181/255 |
| 4,364,761 A | | 12/1982 | Berg et al. | |
| 4,393,652 A | | 7/1983 | Munro | |
| 4,425,304 A | | 1/1984 | Kawata et al. | |
| 4,426,844 A | | 1/1984 | Nakano | |
| 4,541,240 A | | 9/1985 | Munro | |
| 4,851,015 A | * | 7/1989 | Wagner et al. | 181/231 |
| 5,009,065 A | | 4/1991 | Howe | |
| 5,014,510 A | | 5/1991 | Laimbock | |
| 5,016,438 A | | 5/1991 | Harris | |
| 5,043,147 A | | 8/1991 | Knight | |
| 5,108,716 A | | 4/1992 | Nishizawa | |

(Continued)

FOREIGN PATENT DOCUMENTS

| | | |
|---|---|---|
| EP | 475398 | 3/1992 |
| JP | 55-043262 | 3/1980 |
| JP | 57-041414 | 3/1982 |
| JP | 62-291413 | 12/1987 |
| JP | 64-012017 | 1/1989 |
| JP | 02-169812 | 6/1990 |
| JP | 06-257421 | 9/1994 |
| JP | 10141050 | 5/1998 |

*Primary Examiner*—David Martin
*Assistant Examiner*—Eduardo Colon Santana
(74) *Attorney, Agent, or Firm*—Richard C. Litman

(57) ABSTRACT

The exhaust sound and emission control system is a system for reducing sound and noxious emissions from an automotive exhaust. The system may have an exhaust resonator having one or more catalytic converter elements in combination therewith in a single device. Alternatively, the system may have multiple angularly disposed chambers therein, with a series of V-shaped baffles or guides in one of the chambers, thereby combining resonator and muffler functions in a single device. In another alternative, the system has a series of longitudinal tubes therein, in combination with a series of V-shaped guides or vanes, combining catalytic converter, muffler, and resonator functions in a single device. The various elements of the different embodiments, e.g. catalytic converter element(s), double wall shell, perforated tubes and multiple flow paths, interconnecting crossover tubes, etc., may be combined with one another as practicable.

19 Claims, 16 Drawing Sheets

U.S. PATENT DOCUMENTS 5,183,976 A 2/1993 Plemons, Jr.
5,206,467 A 4/1993 Nagai et al.
5,220,789 A 6/1993 Riley et al.
5,248,859 A 9/1993 Borla
5,265,420 A 11/1993 Rutschmann
5,325,666 A 7/1994 Rutschmann
5,355,973 A 10/1994 Wagner et al.
5,378,435 A 1/1995 Gavoni
5,388,408 A 2/1995 Lawrence
5,398,504 A 3/1995 Hirota et al.
5,426,269 A 6/1995 Wagner et al.
5,477,014 A 12/1995 Dunne et al.
5,521,339 A 5/1996 Despain et al.
5,650,599 A 7/1997 Madden et al.
5,881,554 A 3/1999 Novak et al.
5,992,560 A 11/1999 Matsuoka et al.
6,006,859 A * 12/1999 Hussaini ..... 181/227
6,089,347 A 7/2000 Flugger
6,109,026 A 8/2000 Karlsson et al.
6,394,225 B1 5/2002 Yasuda
6,431,311 B1 * 8/2002 Brown et al. ..... 181/282

* cited by examiner

EXHAUST SOUND AND EMISSION CONTROL SYSTEMS

REFERENCE TO RELATED PATENT APPLICATIONS

This application is a continuation-in-part of U.S. patent applications Ser. No. 09/135,804 filed on Aug. 18, 1998 and Ser. No. 10/252,506 filed on Sep. 24, 2002 now U.S. Pat. No. 6,651,733.

BACKGROUND OF THE INVENTION

1. Field of the Invention

The present invention relates generally to automobile exhaust sound and emission control, including a catalytic exhaust converter and a resonator installed within the exhaust system for the reduction of exhaust noise, and to an exhaust sound attenuation and control system having multiple flow paths for reducing exhaust noise.

2. Description of the Related Art

By the time of the 1950s, it was becoming apparent that the ever-increasing volume of automobile and truck traffic was generating exhaust emissions which were adversely affecting the environment. This was particularly true in urban areas and other areas where geographic and meteorological conditions combined to create areas where such emissions do not readily dissipate. Accordingly, by the late 1960s, various regulations were being implemented to require equipment to reduce exhaust emissions output from automobiles, particularly in California and other urban areas.

While early emissions control efforts provided some relief, standards have become increasingly strict in order to keep pace with the ever-increasing volume of automobile and truck traffic throughout the U.S.A. With the development of the catalytic converter, which uses one or more noble metals such as platinum, rhodium, and/or palladium to produce an oxidizing and/or reducing catalytic reaction with the exhaust products and heat generated by the exhaust, a real breakthrough was achieved in the control of vehicle emissions. An automobile equipped with one or more catalytic converters was capable of meeting most, if not all, of the exhaust emissions standards of the time, and the use of catalytic converters became commonplace on automobiles and light trucks powered by spark ignition engines in the U.S.A.

However, long before the recognition of chemical or particulate automobile exhaust emissions as a hazard, another type of automobile exhaust emission had been recognized, i.e., noise or sound. In fact, legislation in virtually every area of the world requires motor vehicles to have equipment which reduces this other emission. Accordingly, mufflers, resonators and other such sound attenuating devices have been known for many years, since shortly after the very earliest development of the internal combustion engine. These two types of emissions control devices, i.e., catalytic converters and mufflers or other sound attenuating devices, have generally not been combined into a single unit due to conflicting characteristics and physical requirements.

In the case of exhaust silencing devices, the maximum desired temperatures for such devices in operation are generally relatively low in comparison to the temperatures achieved in catalytic converters. Mufflers, resonators, and such sound attenuating devices are generally constructed of mild steel, perhaps with an aluminized exterior coating. Very high temperatures cause the aluminized coating to be burned off, and cause both the interior and (after removal of any coating) exterior to be oxidized, to the point of burn-through or rust-through, in relatively short order. While mufflers and other related devices have been constructed of stainless steel in order to reduce oxidation problems, these devices are relatively costly due to the material used and the difficulty in working with such material, in comparison to mild steel. Many, if not most, automobile owners would rather replace a standard steel exhaust system once or twice during their ownership of the car, rather than pay for a replacement system which costs perhaps three times that of a standard, mild steel system.

On the other hand, catalytic converters require relatively high temperatures for efficient operation. If a catalytic converter does not reach a minimum temperature, the catalytic reactions therein will be greatly reduced. Thus, most catalytic converters are constructed of relatively costly materials in order to withstand the heat generated therein. Even so, most converters are installed at some distance from the engine in order to preclude being subjected to excessive heat which could damage them.

While mufflers are generally installed toward the extreme downstream end of the exhaust system, many exhaust systems also incorporate a resonator. Resonators are also sound attenuation devices, but operate on a completely different principle than that of the muffler. The muffler is adapted to cancel most sounds therein by reflecting the sounds (and the exhaust) back and forth through a series of parallel pipes therein, and by forcing the exhaust gases laterally outwardly through relatively small passages in the pipes. The resonator is adapted to pass the exhaust gases therethrough with little or no impedance, while canceling or absorbing sounds within a certain relatively well defined frequency range. This range is generally relatively high, with the muffler being relied upon for the attenuation of lower exhaust frequencies.

As the resonator is adapted to attenuate different frequencies than the muffler, and operates on a different principle, it is generally placed elsewhere in the exhaust system, somewhat forwardly of the muffler, although the resonator may be placed either upstream or downstream of the muffler. The catalytic converter is typically installed forward of the muffler in an automobile, in order to avoid excessive exhaust heat while still accepting sufficient exhaust heat to function. While resonators do not generate internal heat due to chemically reacting the exhaust products, as do catalytic converters, they still must be structured to accept a relatively high exhaust temperature due to their location relatively near the engine. However, heretofore no combining of a catalytic converter and a resonator has been accomplished, to the knowledge of the present inventor.

Accordingly, a need will be seen for a catalytic converter and resonator combination which serves both purposes in a single device. The device may be installed in a conventional automobile exhaust system, between the engine and a conventional muffler and/or tailpipe. Different embodiments may be provided for single and dual exhaust systems, each of which may include one or more catalytic converter elements or "bricks." When used with a pre-catalytic converter, a muffler for further sound attenuation may not be required, depending upon the particular automobile, engine, and exhaust system.

It is also noted that mufflers and resonators have generally not been combined into a single unit due to conflicting characteristics and physical requirements. In another aspect of the present invention, an exhaust sound attenuating device is presented which serves the function of both muffler and resonator in a single unit, and may also include means for treating exhaust emissions as well. While the present inventor has developed devices which combine the function of the catalytic converter and resonator in a single device, he knows of no single device which combines the functions of the muffler and resonator in a single unit, and which may also include at least some limited catalytic conversion function as well. Such a device would be desirable, as it would save space beneath the vehicle, would reduce weight, and would likely reduce exhaust backpressure in comparison to a series of separate devices.

In addition to the above catalytic converter and resonator combination, and resonator and muffler combination with additional catalytic conversion function, the present disclosure also describes a series of alternative embodiments generally comprising a resonator type device having a series of longitudinally disposed tubes of various diameters and lengths therein. At least a portion of the exhaust gases pass through the tubes, with another portion of the gases passing through a series of V-shaped baffles. The net effect is the canceling of exhaust noise across a relatively wide band of sound frequencies. The device may also incorporate one or more catalytic converter elements therewith, and/or may include a removable end or ends therewith for access to internal components. The removable end(s) may be incorporated with other devices disclosed herein, as well.

A discussion of the related art of which the present inventor is aware, and its differences and distinctions from the present invention, is provided below.

U.S. Pat. No. 3,061,416 issued on Oct. 30, 1962 to George P. Kazokas, titled "Catalytic Muffler," describes a device having a series of vanes within the inlet end and a peripherally disposed catalytic material, with a portion of the device further having a backflow of ambient air drawn through the outer shell by entrainment from the exhaust within the device. Kazokas notes his concern regarding the emission of lead in various forms into the atmosphere, from the burning of fuel containing tetraethyl lead. It is also known that the combustion products of leaded fuels will contaminate the catalytic elements of a catalytic converter, rendering it ineffective in a very few miles of vehicle operation using such leaded fuels. The solution provided by Kazokas is to separate the relatively heavy lead particles from other gases by means of centrifugal reaction. He provides a series of centrifugal vanes near the inlet end of his device for this purpose. However, leaded fuels have been banned for many years, and there is no further need to provide any swirling or centrifugal action to the gases passing through such a device. Accordingly, the vanes within the present exhaust devices or systems do not impart any swirling or centrifugal action to the gases passing therethrough. Moreover, the entrainment of ambient air through the outer shell of the Kazokas device has the effect of lowering the internal temperature within the device, thereby lessening the efficiency of the peripherally disposed catalytic conversion material along the inner shell. In contrast, the present systems locate such catalytic conversion materials and elements generally along the center of the device, where maximum temperatures occur to maximize the catalytic conversion reaction.

U.S. Pat. No. 4,032,310 issued on Jun. 28, 1977 to Vincent E. Ignoffo, titled "Muffler And Exhaust Gas Purifier For Internal Combustion Engines," describes a device having three joined components. The first component at the inlet end of the device comprises an empty expansion chamber, with no exhaust modifying componentry therein. The next chamber in line comprises a housing containing small particles of material for chemically treating the exhaust, i.e., carbon particles and/or noble elements for treating the gases catalytically. The outlet portion of the device includes a concentric sound absorbing material which surrounds an outlet pipe, with the volume of the pipe communicating with the sound absorbing material. The Ignoffo device is thus essentially a straight pipe having only a single pathway therethrough, with no convoluted pathway for the gases to follow. Such devices cannot serve as resonators, as they lack the multiple pathways required to cause different frequencies to occur, and to cancel those frequencies, thereby reducing the noise output of the system. While Ignoffo provides for access to the catalytic element of his device, he places this element in the center of the device, requiring both end components to be removed in order to repair or replace the central catalytic element. Moreover, Ignoffo uses a series of bolts installed through flanges, making the operation even more cumbersome. The present system utilizes a much more elegant mechanism for accessing the internal elements of the device.

U.S. Pat. No. 4,050,903 issued on Sep. 27, 1977 to Charles H. Bailey et al., titled "Combination Muffler And Catalytic Converter," describes a device having a relatively convoluted exhaust gas flow path therethrough. The exhaust gases enter through a venturi, which is used to draw air into the exhaust to mix therewith. (It is noted that mufflers are inherently pressurized somewhat higher than ambient when in operation, due to the backpressure created in such devices, yet Bailey et al. do not utilize any other means than the venturi effect to introduce the air into the muffler.) The exhaust and air are mixed by a deflector cone extending into the outlet of the venturi. From this point, the exhaust mixture passes through a series of holes in a transverse plate, and thence through holes in another plate to enter the catalytic converter. The present catalytic converter and resonator combination is a straight through, axial flow, free flow configuration, adapted for the attenuation of specific frequencies, unlike the muffler configuration of Bailey et al. Also, the catalytic converter element of the present invention is located within the forward portion of the device, where it is subjected to the highest possible exhaust heat which occurs within the entire device. Bailey et al. locate their catalytic converter element in the rearward portion of the device, where the exhaust gases have cooled somewhat by their passage through the convoluted flow path of the forward muffler portion of the device. As the muffler itself is generally located to the rear of the exhaust system, some efficiency would be lost in the Bailey et al. device, due to the relatively cooler exhaust temperatures by the time the exhaust gases arrive at the catalytic converter element.

U.S. Pat. No. 4,364,761 issued on Dec. 21, 1982 to Morris Berg et al., titled "Ceramic Filters For Diesel Exhaust Particulates And Methods For Making," describes a particulate trap for use with diesel engines. The Berg et al. device comprises a ceramic unit having a series of inlet and outlet passages therein. However, the inlet and outlet passages are not connected to one another. Rather, the ceramic material is porous, to allow gases to flow through the walls of the ceramic material from the inlet side to the outlet side. The porosity is configured to allow exhaust gases to flow, but to trap larger carbon particles typically generated during diesel engine operation. While Berg et al. describe their ceramic structure as having thin walls, this device cannot be used as a catalytic converter element, as the catalytic coatings would block the minute porosities between the inlet and outlet passages, thereby blocking gas flow through the device. In contrast, the present invention in its various embodiments utilizes conventional catalytic converter elements, and/or coats the sides of the internal passages with catalytic material to provide the desired reactions while also allowing exhaust gases to flow through the device.

U.S. Pat. No. 4,393,652 issued on Jul. 19, 1983 to John H. Munro, titled "Exhaust System For Internal Combustion Engines," describes an exhaust device including an upstream muffler, a generally centrally located spark and moisture arrestor, and a downstream chamber having a replaceable catalytic element therein. The disadvantage of locating the catalytic element farther from the combustion source, where the element receives less heat from the exhaust and thus produces a less efficient reaction, has been noted further above. Moreover, Munro describes the use of a gas absorbent or adsorbent material, such as charcoal, in combination with his catalytic element. The use of an adsorbent material such as charcoal in a motor vehicle engine exhaust system is not understood, as the relatively large volume of exhaust gases passing through the system would result in the adsorption of only a miniscule quantity of impurities in the exhaust, in comparison to the total exhaust volume relative to the amount of charcoal in the system. The amount of charcoal required to absorb the vast majority of impurities from the exhaust of a motor vehicle engine, would be prohibitive.

U.S. Pat. No. 4,425,304 issued on Jan. 10, 1984 to Masayuki Kawata et al., titled "Catalytic Converter," describes a device comprising a single shell or container with two converter units or "bricks" installed in series therein. No sound attenuating means is disclosed by Kawata et al. in their catalytic converter.

U.S. Pat. No. 4,426,844 issued on Jan. 24, 1984 to Keiichi Nakano, titled "Engine Muffler Of Heat-Exchanging Type," describes a device incorporating a pair of catalytic converter components therein. The two catalytic converter components are positioned in front of the heat exchanger, which also acts as a muffler. Exhaust gas flow enters the device by means of a radial pipe, and flows radially to enter and exit the myriad of axial heat exchange passages in the muffler and heat exchanger element. In contrast, the present invention provides for strictly straight through, axial flow of exhaust gases therethrough, in order to reduce backpressure therein and provide the greatest possible free flow of the exhaust gases. The present device is not a muffler, with a convoluted and restrictive flow path, but rather is a resonator, adapted for the reduction or canceling of certain specific exhaust gas frequencies.

U.S. Pat. No. 4,541,240 issued on Sep. 17, 1985 to John H. Munro, titled "Exhaust System For Internal Combustion Engines," is a divisional patent of the parent '652 U.S. Patent to the same inventor, discussed further above. The same points raised in the discussion of the Munro '652 Patent are seen to apply to the Munro '240 U.S. Patent as well.

U.S. Pat. No. 5,014,510 issued on May 14, 1991 to Franz Laimbock, titled "Exhaust System, Particularly For Two-Stroke Cycle Internal Combustion Engines," describes an exhaust assembly having a relatively wider expansion area which includes a primary catalytic converter therein. A longitudinal divider is installed upstream of the primary catalytic converter element, with the divider also being coated with catalytically reactive material. It is well known that two stroke cycle exhaust systems are relatively limited in their configurations, as it is critical that the system be tuned so as to assist each exhaust pulse in its passage in order to draw the subsequent pulse or charge from the cylinder, in order to attain optimum efficiency and to preclude overheating of the engine. Accordingly, Laimbock does not provide any internal baffling within his exhaust system in order to attenuate noise levels, as is provided by the present exhaust system.

U.S. Pat. No. 5,016,438 issued on May 21, 1991 to Harold L. Harris, titled "Emission Control Apparatus," describes a combination exhaust device having a pair of catalytic converter elements in tandem therein. Only a portion of the exhaust gases pass through the first element, with some of those gases being recirculated back through the first element. All of the exhaust gases pass through the second element. In contrast, all exhaust gases pass through all of the catalytic converter elements of the present invention, when plural elements are provided in tandem. In addition, Harris places his catalytic elements generally in the center of his exhaust device, where the heat is reduced in comparison to the entry end of the device. The loss of efficiency for catalytic converter elements operating at lower heat levels, has been noted further above.

U.S. Pat. No. 5,043,147 issued on Aug. 27, 1991 to Glen Knight, titled "Combined Muffler And Catalytic Converter Exhaust Unit," describes a device with a pair of converters being installed within the first portion of the muffler shell. The exhaust gases are then forced to travel a sinusoidal, convoluted path forward and aft through the muffler portion, with gases being exchanged between various pipes within the muffler portion due to perforations provided through the pipes. The present straight through, free flow resonator provides greatly reduced backpressure, in comparison to a muffler configuration such as the Knight apparatus. The disadvantages of including catalytic converters within a muffler located toward the outlet end of the exhaust system, with its reduced heat, have been noted further above in the discussion of the patent to Bailey et al., and apply here as well.

U.S. Pat. No. 5,108,716 issued on Apr. 28, 1992 to Kimiyoshi Nishizawa, titled "Catalytic Converter," describes a device having two converter components housed within a single container or shell. No sound attenuation means is disclosed by Nishizawa, as provided by the present catalytic converter and resonator combination.

U.S. Pat. No. 5,183,976 issued on Feb. 2, 1993 to R. J. Plemons, Jr., titled "Adjustable Sound Attenuating Device," describes a resonator type device having essentially a straight through flow pattern. No double wall outer shell, additional sound insulating material, or catalytic elements are disclosed by Plemons, Jr. in his exhaust device.

U.S. Pat. No. 5,206,467 issued on Apr. 27, 1993 to Noboru Nagai et al., titled "Muffler With A Catalyst," describes a relatively small, canister type muffler as used on small two and four stroke engines (e.g., lawnmowers, etc.). The Nagai et al. muffler essentially has four compartments, with a pipe-like first compartment projecting into a second compartment, which communicates with a third compartment which leads to a small fourth compartment with a relatively small exhaust outlet passage. The exhaust gases do not pass longitudinally through a series of elongate passages, as in the present system, and the configuration of the Nagai et al. device cannot provide any resonator effect.

U.S. Pat. No. 5,220,789 issued on Jun. 22, 1993 to James E. Riley et al., titled "Integral Unitary Manifold-Muffler-Catalyst Device," describes an exhaust manifold and system which is bolted directly to the cylinder head of the engine. While Riley et al. include a conventional catalytic converter element, or "brick," within their manifold, they fail to include any internal baffling to control the exhaust sound level within their manifold. The only internal passages within their device are formed by the relatively small, straight passages of the catalytic converter element itself, which Riley et al. prefer to be as nearly straight as possible to encourage laminar flow therethrough. In contrast, the present system provides a circuitous exhaust flow path therethrough, to attenuate noise levels optimally.

U.S. Pat. No. 5,248,859 issued on Sep. 28, 1993 to Alexander Borla, titled "Collector/Muffler/Catalytic Converter Exhaust Systems For Evacuating Internal Combustion Engine Cylinders," describes various embodiments of an exhaust system in which a muffler jacket may be installed surrounding a collector unit. Borla also provides catalytic converter elements, but in each case the catalytic converter elements are installed as separate units within the individual exhaust header pipes adjacent the cylinder head of the engine, or in the individual header pipes immediately upstream of the collector. No internal resonator structure is provided by Borla, nor does he utilize a single catalytic converter element or multiple elements in tandem disposed within a single exhaust passage, as provided by the present exhaust system invention.

U.S. Pat. No. 5,265,420 issued on Nov. 30, 1993 to Erwin Rutschmann, titled "Exhaust System Of A Multi-Cylinder Reciprocating Engine," describes a system in which a single catalytic converter is provided for each cylinder bank of a V-8 engine. Exhaust gases pass through the two catalytic converters, thence to a single transverse muffler. Thus, Rutschmann requires three separate housings or units for the two catalytic converters and single muffler of his system, whereas the present catalytic converter and resonator combination are combined within a single housing. Also, the Rutschmann system does not provide straight through flow, but requires the exhaust gases to make several turns between the catalytic converters and the transverse muffler inlet and outlet. No resonator is disclosed by Rutschmann.

U.S. Pat. No. 5,325,666 issued on Jul. 5, 1994 to Erwin Rutschmann, titled "Exhaust System Of An Internal-Combustion Engine," describes a system somewhat similar to the apparatus of the '420 U.S. Patent to the same inventor, discussed immediately above. The convoluted routing of the exhaust gases, the use of separate housings or components for the catalytic converters and mufflers, the use of a plenum around the catalytic converters, and other differences, make the Rutschmann apparatus distinct from the present catalytic converter and resonator combination. Again, it must be noted that a muffler is not a resonator, and does not provide straight through flow of exhaust gases and the attenuation of a relatively narrow range of frequencies.

U.S. Pat. No. 5,355,973 issued on Oct. 18, 1994 to Wayne M. Wagner et al., titled "Muffler With Catalytic Converter Arrangement; And Method," describes a muffler having a straight flow through pattern; no convoluted or sinusoidal flow pattern is provided in the Wagner et al. exhaust device. While Wagner et al. provide a concentric tubular element within their muffler, they do not provide a series of parallel tubular exhaust passages serving as a resonator, as in the present invention, nor do they provide a series of V-shaped baffles in combination with such tubular elements. Moreover, no double walled shell having additional acoustic insulation therein is disclosed by Wagner et al., which structure is a part of at least some embodiments of the present exhaust system invention.

U.S. Pat. No. 5,378,435 issued on Jan. 3, 1995 to Albino Gavoni, titled "Silencer Combined With Catalytic Converter For Internal Combustion Engines And Modular Diaphragm Elements For Said Silencer," describes an essentially a cylindrical container with a series of cup-shaped catalytic converter elements arranged therein. The elements are each relatively thin, due to the cup-like shape of each element, and thus do not present a significant cross sectional area to the exhaust gases passing therethrough. Thus, a great many such elements are required, unlike the present catalytic converter and resonator combination.

U.S. Pat. No. 5,388,408 issued on Feb. 14, 1995 to Phillip G. Lawrence, titled "Exhaust System For Internal Combustion Engines," describes a dual muffler system, in which the mufflers are teed from a single exhaust line upstream, which is in turn fed by one or more catalytic converters. The mufflers of the Lawrence system are essentially straight through devices having a series of pipes therein of different lengths. While the Lawrence system discloses dual mufflers, their connection to a single point upstream is unlike the dual exhaust embodiment of the present invention. Moreover, no V-shaped vanes are provided by Lawrence in combination with his plurality of different length tubes, nor does he provide one or more catalytic converter elements contained within the same housing as the muffler and resonator device, as is done with the present invention.

U.S. Pat. No. 5,398,504 issued on Mar. 21, 1995 to Tomotaka Hirota et al., titled "Layout Structure Of Catalytic Converters," describes a system in which first and second converters are installed immediately adjacent the respective cylinder banks of a V-configuration engine. A separate third, main converter is provided beneath the engine. Each of the converters is contained in a separate housing or shell, unlike the combined catalytic converter and resonator of the present invention. Moreover, Hirota et al. do not disclose any form of exhaust silencing or noise attenuating means in their system, as is provided by the present catalytic converter and resonator combination.

U.S. Pat. No. 5,426,269 issued on Jun. 20, 1995 to Wayne M. Wagner et al., titled "Muffler With Catalytic Converter Arrangement; And Method," describes a series of embodiments of a muffler having a conventional catalytic converter element axially disposed therein. The path of the exhaust gas flow may take any of a few different routes, depending upon the specific embodiment of the Wagner et al. device. In at least one embodiment, the flow passes axially through the muffler, from one end to the other. In at least one other embodiment, flow doubles back through the muffler shell to exit radially from a port adjacent the axial inlet. None of the embodiments disclose a multiple path internal configuration corresponding to that of the present device.

U.S. Pat. No. 5,477,014 issued on Dec. 19, 1995 to Stephen R. Dunne et al., titled "Muffler Device For Internal Combustion Engines," describes an otherwise conventional muffler, but having an internal coating of zeolite material for protecting the underlying metal structure from corrosion. The Dunne et al. coating does nothing to catalyze exhaust emissions, but is solely directed to the protection of the metal structure of the muffler. Moreover, the Dunne et al. muffler is conventional, as noted above. Among other conventional features, it includes relatively small diameter internal passages, which have diameters smaller than those of the inlet and outlet pipes. This results in excessive flow restriction, which is avoided in at least one of the embodiments of the present exhaust system configuration with its relatively large diameter internal passages.

U.S. Pat. No. 5,521,339 issued on May 28, 1996 to Michael S. Despain et al., titled "Catalyst Muffler System,"

describes a relatively small muffler unit intended for use on a two stroke cycle type engine, e.g., chainsaw, lawnmower, etc. The Despain et al. muffler passes the exhaust gases back over the catalytic converter element therein, after passing through the catalyst element. No multiple paths for exhaust gases are provided by the Despain et al. muffler, whereas the present system includes such passages in each of its various embodiments.

U.S. Pat. No. 5,650,599 issued on Jul. 22, 1997 to Peter E. Madden et al., titled "Noise Cancellation Method And Apparatus," describes a device employing electronic noise canceling means. The device is primarily directed to use with a reaction type engine, e.g., a turbojet, rather than to the exhaust of a reciprocating engine or the like. The exhaust is divided into a series of separate ducts, with each duct having its own electronic noise canceling system or apparatus therein. No acoustic muffling or resonating means is disclosed by Madden et al., nor is any catalytic or other conversion of exhaust products disclosed by Madden et al.

U.S. Pat. No. 5,881,554 issued on Mar. 16, 1999 to James Michael Novak et al., titled "Integrated Manifold, Muffler, And Catalyst Device," describes a relatively large and bulky assembly having a series of individual exhaust tubes within a larger manifold housing. The tubes lead to a catalytic converter element, with the internal manifold volume also communicating with the catalytic element. The tubes are perforated to allow gas flow to pass therefrom to the internal volume of the manifold, whereby the assembly acts as a resonator. However, while Novak et al. state that their device also serves as a muffler, no muffler elements are disclosed within the device. In contrast, the present system provides multiple flow paths as a muffler and resonator.

U.S. Pat. No. 5,992,560 issued on Nov. 30, 1999 to Hirotake Matsuoka et al., titled "Muffler For Internal Combustion Engine," describes a straight through flow configuration having circumferentially surrounding acoustic absorbent material. The acoustic absorbent material is preferably glass fiber, which Matsuoka et al. describe as being susceptible to melting and forming small beads, which then pass through the perforations in the inner pipe to be blown from the exhaust system. Matsuoka et al. provide a "scattering prevention member" comprising a fine mesh wire screen surrounding the inner pipe, in order to retain any fine glass beads which may be formed, within their intended area. Matsuoka et al. do not disclose any multiple tube construction, multiple flow paths, catalytic converter elements, or other features of the present invention.

U.S. Pat. No. 6,089,347 issued on Jul. 18, 2000 to Ray T. Flugger, titled "Muffler With Partition Array," describes a series of embodiments each having a number of angled deflector plates installed therein. Some of the embodiments include a series of V-shaped deflectors therein. However, none of the embodiments of the Flugger muffler configurations include any form of multiple pipes providing multiple flow paths, double wall construction, catalytic converter elements, or other features of the present exhaust system invention.

U.S. Pat. No. 6,109,026 issued on Aug. 29, 2000 to Egon Karlsson et al., titled "Muffler With Catalytic Converter," describes a small canister type muffler for use with relatively small two stroke cycle type engines. The Karlsson et al. muffler has a configuration more closely resembling that of the Nagai et al. '467 and Despain et al. '339 U.S. Patents, than the present exhaust system invention. The points of difference raised in the discussion of the Nagai et al. and Despain et al. mufflers, are seen to apply here as well.

U.S. Pat. No. 6,394,225 issued on May 28, 2002 to Kazuhiro Yasuda, titled "Muffler Structure," describes a muffler having a series of tubes installed within an outer shell. The tubes are held in place by internal baffles, which cause the gases to flow back and forth through the various tubes. However, Yasuda does not include any form of V-shaped baffles or guides within his muffler nor does he provide any form of catalytic converter element, removable end component, or other features of the present exhaust system invention.

Japanese Patent Publication No. 55-43262 published on Mar. 27, 1980 illustrates an exhaust gas purifier in which the catalytic converter unit includes a baffle within its inlet end to preclude interference between exhaust gases alternatingly entering the converter from the no. 1 and no. 4 cylinders, and the no. 2 and no. 3 cylinders. No muffler, resonator, or other sound attenuating means is apparent, as is provided in the present catalytic converter and resonator combination invention.

Japanese Patent Publication No. 57-41414 published on Mar. 8, 1982 illustrates a method of manufacturing a catalytic converter equipped with a muffler. The assembly includes a forward muffler with a catalytic converter welded thereto and downstream thereof, with a rear muffler welded to the downstream end of the catalytic converter. The present catalytic converter and resonator combination utilizes a single, monolithic shell enclosing both the catalytic converter and resonator components, with no welding of separate components being required to form the housing or shell for the device. A "protector 37" (per the English abstract), apparently comprising an outer shell spaced apart from the inner housing containing the catalytic converter, is welded over the remainder of the assembly, unlike the present catalytic converter and resonator combination with its single shell or housing. No disclosure is apparent regarding any provision for a straight through, free flow resonator or removable end component, as provided by the present invention.

Japanese Patent Publication No. 62-291,413 published on Dec. 18, 1987 to Michio Hayashi describes (according to the drawings and English abstract) a muffler configuration having a series of longitudinally disposed tubes therein, with the tubes held in place by a pair of baffles or bulkheads. Hayashi stiffens the bulkheads by forming them of two sheets of material with a fill of sound deadening material, in order to preclude vibration at certain frequencies. However, Hayashi does not provide any V-shaped guides or the like, nor does he provide a double wall shell extending for the entire length of the device, catalytic converter element(s), removable end component, or other features of the present exhaust system invention.

Japanese Patent Publication No. 64-12,017 published on Jan. 17, 1989 to Yoji Nagai describes (according to the drawings and English abstract) a catalytic converter construction wherein the converter is formed of a corrugated plate, with the plate surfaces being coated with the catalytic material. The corrugated plate is then rolled to form a multitude of channels, through which the exhaust gases pass and are catalytically reacted. Such a catalytic converter construction is also disclosed in the '859 U.S. Patent to Borla, discussed further above. While the present exhaust system invention may make use of such a catalytic converter construction, the '017 Japanese Patent Publication does not disclose the use of a double wall shell, removable end components, a catalytic converter in combination with other exhaust components, nor the specific internal construction of the present exhaust system invention.

Japanese Patent Publication No. 2-169,812 published on Jun. 29, 1990 to Yuichi Ito et al. describes (according to the drawings and English abstract) a muffler or the like wherein the outer shell is coated with a resin for rust and damage protection. Dual end caps are shown, but the outer outlet end cap and its attached exhaust pipe are not attached to the outlet tube of the device, which is held in place within the end of the exhaust pipe by the inner outlet end cap. This construction is quite different from that of any of the embodiments of the present invention. Moreover, while the '812 Japanese Patent Publication shows a series of internal tubes providing a sinusoidal flow path, there is no lateral gas flow between the tubes; all gases must flow from one end to the other sequentially, unlike the flow through the various embodiments of the present exhaust system invention. Such lateral flow and/or parallel flow paths are essential in a resonator type device, in order to separate and cancel various sound frequencies of the gases passing through the device. It is also noted that there is no provision for any form of V-shaped vanes or guides within the exhaust device of the '812 Japanese Patent Publication, whereas such internal vanes are a part of many of the embodiments of the present invention. Finally, the '812 Japanese Patent Publication does not appear to disclose any form of emissions treatment, such as the catalytic converter elements which are a part of most of the embodiments of the present invention.

European Patent Publication No. 475,398 published on Mar. 18, 1992 to Suzuki Kabushiki Kaisha, titled "Muffler Assembly For Engine," describes a device having double wall construction with a series of three concentric internal pipes. None of the pipes communicate directly with one another, and the inlet end of the outlet pipe is capped. All gas flow into and from the pipes is through peripheral holes formed in the pipes. While the '398 European Patent Publication discloses a double wall construction, no insulation or other material is placed between the two walls. Also, there is no disclosure of any form of catalytic converter element(s) within the exhaust device of the '398 European Patent Publication.

Finally, Japanese Patent Publication No. 6-257,421 published on Sep. 13, 1994 to Kohei Tomita describes (according to the drawings and English abstract) an exhaust device having a configuration very similar to that of the '413 Japanese Patent Publication, discussed further above. As in the case of the '413 Japanese Patent Publication, the '421 Japanese Patent Publication does not disclose any V-shaped guides or the like, nor does it disclose a double wall shell extending for the entire length of the device, catalytic converter element(s), removable end component, or other features of the present exhaust system invention.

None of the above inventions and patents, taken either singly or in combination, is seen to describe the instant invention as claimed. Thus exhaust sound and emission control systems solving the aforementioned problems are desired.

SUMMARY OF THE INVENTION

The exhaust sound and emission control systems of the present invention comprise a series of devices for attenuating sound and noxious emissions primarily for, but not limited to, an automobile exhaust system. In one aspect, the system relates to a catalytic converter and resonator combination, combined within a single canister or shell. The combination device may be installed between the engine and a muffler at or near the downstream or exhaust outlet end of the exhaust system, with the system perhaps including an additional catalytic converter(s) upstream of the catalytic converter and resonator combination. The placement of the catalytic converter and resonator combination forward of the muffler and tailpipe of the exhaust system, with the converter element forward of the resonator element, ensures that the converter portion of the combination will receive exhaust gases at a sufficiently high temperature to produce the desired catalytic reaction and thereby oxidize and/or reduce the exhaust components to harmless products. The catalytic converter element may be formed of a thin wall ceramic material, for further efficiency. Heated and/or electronic catalytic converter devices may be implemented to enhance emissions reduction.

The resonator portion of the combination is a straight through, free flow configuration, with all components being concentric to one another in the single exhaust configuration for greater efficiency. The resonator includes a central pipe with a plurality of relatively small holes or passages therethrough, for attenuating or canceling a relatively narrow band of frequencies produced by the engine exhaust. An alternative embodiment may include a dual exhaust version, with two side by side resonator pipes behind the catalytic converter portion, and either embodiment may include one or more catalytic converter elements therein.

As noted above, a resonator operates on the principle of canceling or impeding certain frequencies of sound within a relatively narrow band or range. The loudest sounds produced by various internal combustion engines will vary in frequency, depending upon the engine configuration (number of cylinders, cylinder layout, etc.), and other factors, including installation, etc. Accordingly, it is important to be able to adjust or tune a resonator for a given installation, in order to attenuate sounds within a predetermined range. The present combination catalytic converter and resonator invention may be structured to provide for such adjustment at the time of manufacture or assembly, as desired. Also, additional sound absorbing material may be installed within the device if desired, surrounding the inner resonator pipe or tube, to absorb sounds which might otherwise be transmitted through the outer shell of the device.

In another aspect, the system of the present invention comprises an exhaust sound attenuation and control system for use with internal combustion engines of any practicable type and configuration which combines the functions of a muffler and a resonator. In this aspect, the system generally comprises an outer shell containing multiple flow paths therein for exhaust gases, with the flow paths resulting in the canceling of certain frequencies of exhaust noise (i.e., acting as a resonator) and also lowering exhaust noise generally throughout the frequency range (i.e., acting as a muffler). Internal components of the present exhaust system may be coated with emissions reduction material in order to provide some limited catalyzing of exhaust emissions, as well.

In this regard, the system is configured so that the cross-sectional areas of the internal and outlet pipe passages are at least equal to, and are preferably greater than, the cross-sectional area of the inlet pipe. This provides relatively free flowing characteristics for the present system, thus reducing back pressure in the exhaust system and improving the efficiency of operation of the associated engine.

Such a system is relatively compact, particularly in comparison to the separate muffler and resonator systems of the prior art. The compact, integrated configuration of the present system enables it to be installed at virtually any location in the vehicle exhaust system. The system may be formed of high temperature resistant materials (e.g., corrosion resistant steel, etc.), as required, for installing adjacent to the vehicle engine. Additionally, the exterior and/or interior of the body may be covered with a ceramic jet coat or comparable thermal coating to retain internal temperature, significantly reducing the external temperature and creating more efficient emission reduction and enabling the unit to be in closer proximity to surrounding objects.

The system may be adapted for use as a single or dual system, with crossover pipes as required. The crossover pipes may comprise a single pipe or a plurality of pipes between two or more exhaust control devices of the present invention, and may connect similar or dissimilar chambers or passages within the different devices, as desired, to enhance the versatility of the system.

In still another aspect, the system of the present invention essentially comprises a resonator and catalytic converter combination together with structural features associated with a muffler. In this configuration, the system incorporates a device with a series of internal tubes of different lengths and diameters, with exhaust flow being separated to pass through the various tubes. This results in the canceling of various frequencies, according to the resonance of a column of gas within each of the pipes. The device may also incorporate a series of V-shaped vanes or guides therein, and one or more catalytic converter elements. Any of the various components of any of the embodiments disclosed herein, may be combined where practicable with any of the other components of any of the other embodiments.

Accordingly, it is a principal object of the invention to provide an exhaust sound and emission control system which combines catalytic converter and resonator functions into a single device.

It is another object of the invention to provide an exhaust sound and emission control system for an internal combustion engine which includes a device that combines and includes features and functions of a muffler and resonator in a single device.

It is another object of the invention to provide an exhaust sound and emission control system having a resonator configuration incorporating a series of internal tubes of differing lengths and diameters from one another, for creating phase canceling resonant frequencies therein.

It is yet another object of the invention to provide an exhaust sound and emission control system having such a resonator configuration which may also include various baffles, guides, and/or catalytic converter elements, thereby combining catalytic converter, muffler and resonator functions into a single device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises several different embodiments of exhaust sound and emission control systems, with FIGS. 1 through 8 illustrating a first series of embodiments comprising a catalytic converter and resonator combination. The embodiments of FIGS. 1 through 8 include at least one (or more) catalytic converter element(s) within the same canister or shell used to house an exhaust resonator, which is normally used for the attenuation or canceling of exhaust noise or sound in a relatively narrow frequency range. Such resonators generally include a plurality of relatively small perforations therein, with the size of the perforations being configured according to the frequency or frequencies which are to be attenuated or canceled. Resonators are not mufflers, in that they do not serve to attenuate or cancel a broad range of exhaust frequencies, but rather reduce or eliminate certain objectionable frequencies or levels which are more difficult to attenuate using a conventional muffler.

Such resonators, if used, are frequently installed in an exhaust system forwardly of the conventional muffler, between the muffler and the: engine exhaust manifold or catalytic converter downstream (i.e., in the direction of exhaust gas flow) from the manifold. Accordingly, resonators accept a fair amount of exhaust heat, somewhat more than that seen by the muffler near the outlet end of the exhaust system. As catalytic converters require a certain minimum amount of heat for efficient operation of the catalytic reaction(s) occurring therein, the embodiment of the present invention shown in FIGS. 1–8 combines at least one catalytic converter with a resonator, where the converter may receive a reasonable amount of exhaust heat.

Figure 1:
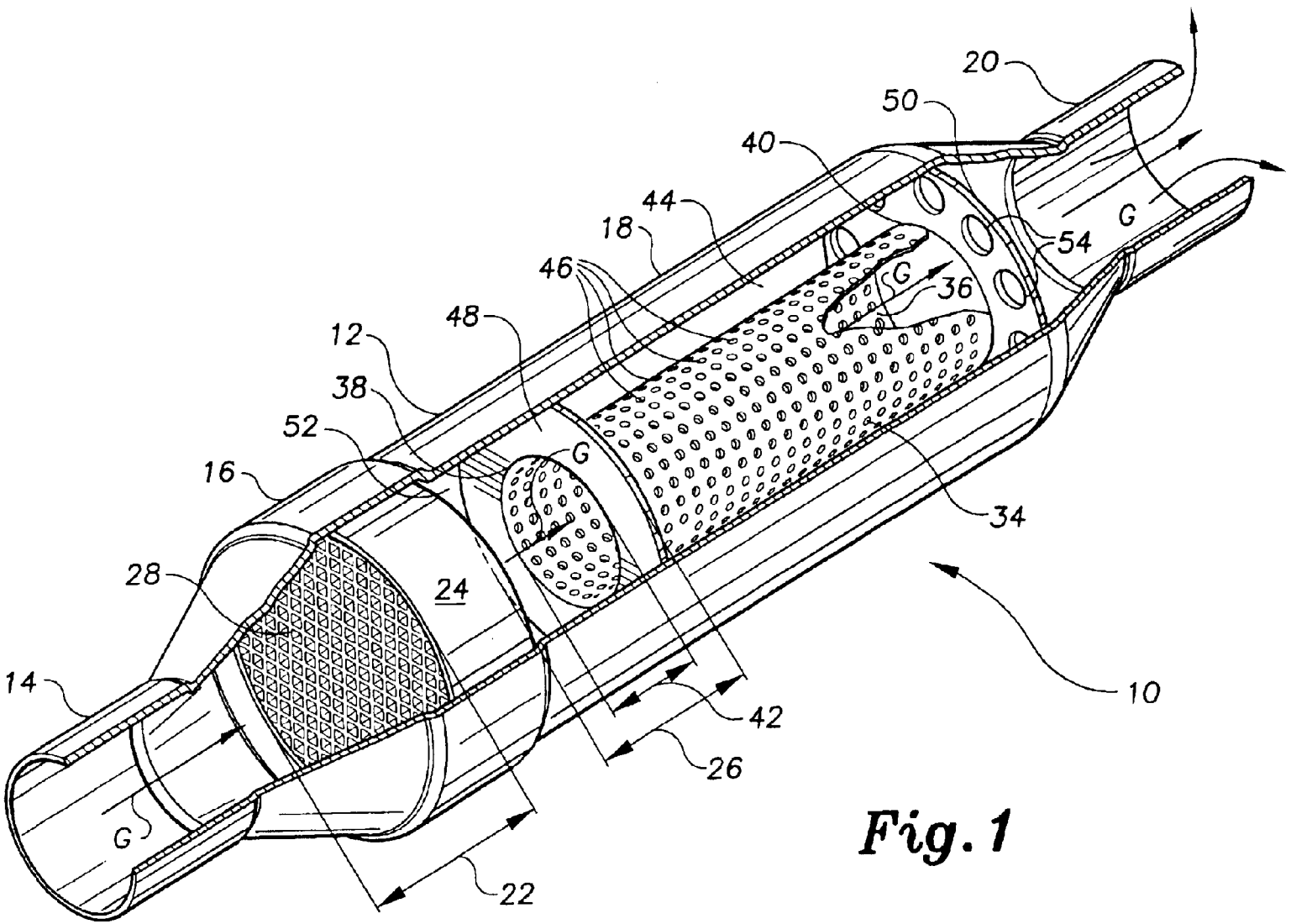
FIG. 1 is a perspective view in partial section of a single exhaust catalytic converter and resonator combination of the present invention, showing its structure and features.

A first embodiment of the present catalytic converter and resonator combination is shown in FIG. 1, and is designated by the reference numeral 10. The embodiment 10 of FIG. 1 comprises a hollow, monolithic tubular canister or shell 12, having a forward or inlet end 14, a forward portion 16 immediately behind and adjacent the inlet end 14, a rearward portion 18 immediately behind and adjacent the forward portion 16, and a rear or outlet end 20 immediately behind and adjacent the rearward portion 18. The forward portion 16 has an inner diameter 22 which is dimensioned to accept at least one catalytic converter element 24 therein, with the catalytic converter element 24 installed therein having an outer diameter (also designated by the reference numeral 22) substantially equal to the inner diameter 22 of the canister 12. The rear portion 18 of the canister 12 has an inner diameter 26 dimensioned to accept a resonator element therein.

Figure 6:
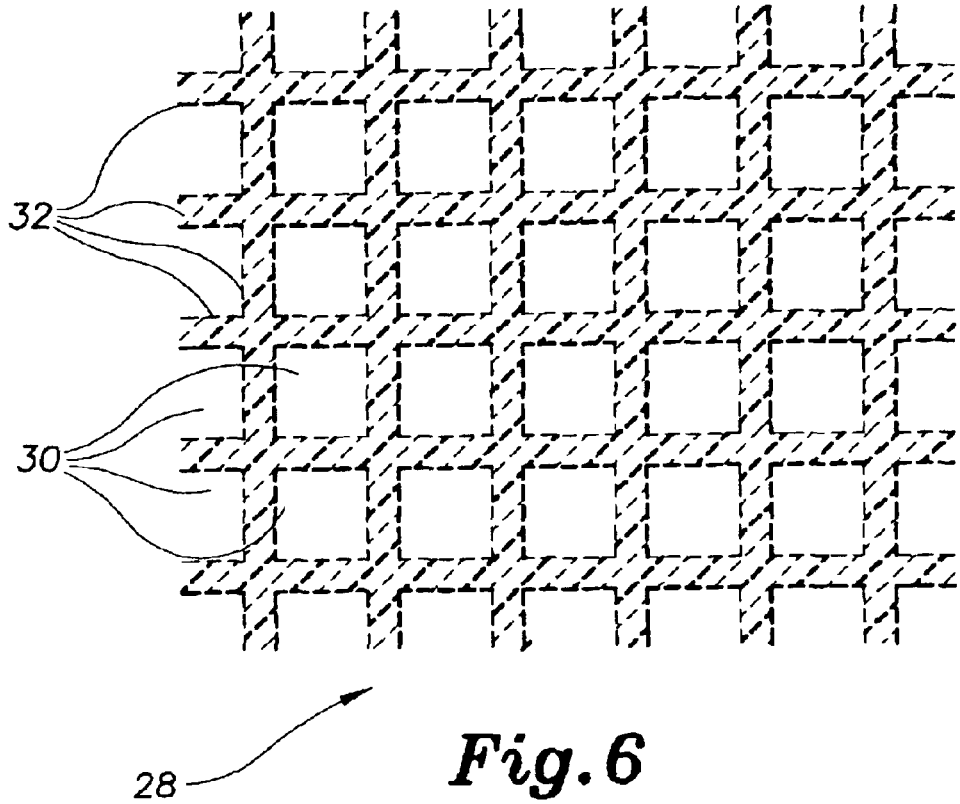
FIG. 6 is a detailed front elevation view of the substrate element and flow passages of the present catalytic converter element showing the thinner walls and larger passages therethrough.

The catalytic converter element 24 includes a substrate 28 having a plurality of longitudinal passages 30 therethrough, with each of the passages 30 being defined by a plurality of walls 32, as shown in detail in FIG. 6. These walls 32 may be generally horizontally and vertically oriented to form a honeycomb or grid-like configuration when viewed in lateral cross section, as shown in FIG. 6. Each of the walls 32 is coated with one or more catalytically reactive elements or materials, e.g., noble metals such as platinum, palladium, rhodium, etc., as is known in the art.

Figure 7:
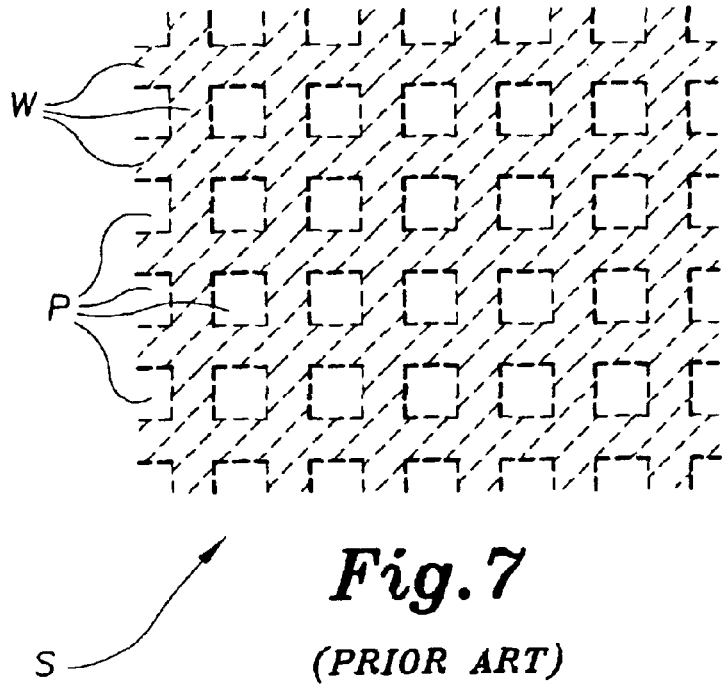
Fig. 7 (PRIOR ART)
FIG. 7 is a detailed front elevation view of a prior art substrate element for a catalytic converter, showing the relatively thick walls and narrow passages therethrough.

The efficiency of the present converter 24 is increased by constructing the substrate 28 with the walls 32 having a relatively thin cross section and the passages 30 therebetween being relatively wide, in order to reduce the restriction to exhaust gas flow as much as possible. A comparison of the present substrate 28 with a prior art substrate S shown in FIG. 7, clearly shows the wider passages 30 of the present substrate 28. The walls W of conventional substrates, such as the substrate S shown in FIG. 7, are relatively thick due to the need for structural strength at the elevated temperatures occurring within catalytic converters. These walls W are normally somewhat thicker than required for structural strength at normal temperatures, but due to the extremely elevated temperatures occurring within a catalytic converter, they must be made even thicker to provide the required structural strength at such elevated temperatures where most materials are weakened.

The relative thickness of the walls W of conventional catalytic converter substrates S results in the passages P therebetween having a relatively narrow width, as may be seen in a comparison of a conventional catalytic converter substrate cross section in FIG. 7 and the substrate 28 of the present catalytic converter and resonator invention. Typically, such conventional passages P have a width on the order of 0.040 inch, for a passage cross sectional area of about 0.0016 inch. Wider passages, with the walls therebetween being spaced further apart, would not provide the required structural strength at the elevated temperatures occurring within such conventional catalytic converters.

On the other hand, the catalytic converter substrate 28 of the present catalytic converter and resonator combination 10 has passage widths substantially greater than 0.040 inch, preferably on the order of 0.050 inch for a passage cross sectional area of 0.0025 inch, or over half again as great an area as the conventional catalytic converter passage P. Yet, the number of passages 30 in a given cross sectional area of the present substrate 28 closely approaches that of the passages P in a conventional converter substrate S, due to the relatively thin substrate walls 32 of the present converter substrate 28. Due to their relatively high surface area per pass and volume ratio, the thin substrate walls 32 serve to absorb heat more quickly than the relatively thick walls W of prior art substrates S. This allows the present catalytic converter element 24 to reach its normal operating temperature more quickly than catalytic converters of the prior art, thus reducing the "cold start" period when emissions are relatively high due to the need for exhaust gases to warm up the converter to reach an optimum temperature for the catalytic reactions to occur efficiently. Thus, the catalytic converter 24 of the present catalytic converter and resonator combination 10 reduces the period of time following a cold start when exhaust emissions are relatively high due to the catalytic converter being relatively cool.

While conventional converter substrates S have been formed of relatively expensive metals in order to provide the required structural strength at the elevated temperatures found in such devices, the catalytic converter 24 of the present catalytic converter and resonator combination 10 preferably uses a ceramic material for the substrate walls 32. Such ceramic materials provide excellent resistance to heat, but a relatively strong material is required in order to provide the required structural strength, particularly in the case of the relatively thin substrate walls 32 of the present invention. A ceramic material known as Dow-Corning XT®, manufactured by the Dow-Corning Company, has been found to be suitable for the construction of such thin wall catalytic converter substrates 28 of the present invention. Other materials providing sufficient structural strength at the elevated temperatures experienced within an operating catalytic converter, may be used as desired.

The canister rearward portion 18 includes a resonator element 34 installed therein. The resonator element 34 is a generally tubular or cylindrical device, which may be rolled from a flat sheet of suitable metal or otherwise formed. The resonator element 34 has a hollow core 36, a forward end 38, an opposite rearward end 40, and an outer diameter 42 which is substantially less than the inner diameter 26 of the rear portion 18 of the canister 12. This difference between the inner diameter 26 of the canister rearward portion 18 and the outer diameter 42 of the resonator element 34, defines a sound attenuating plenum 44 therebetween.

The resonator element 34 includes a plurality of sound attenuating perforations 46 formed radially therethrough, for the attenuation of exhaust sound in a relatively narrow range of frequencies. The passages or perforations 46 may be dimensioned and spaced to accommodate different frequency ranges as desired, as is known in the art.

The resonator element 34 is secured concentrically within the canister rearward portion 18 by a forward plate 48 and opposite rearward plate 50, affixed respectively to the forward end 38 and rearward end 40 of the resonator tube 34 and within the rearward portion 18 of the canister 12, normal to the axis of the resonator pipe 34 and canister 12. These two plates 48 and 50 are toroid shaped, to allow exhaust gases to pass from a plenum 52 disposed between the catalytic converter element 24 and the forward end 38 of the resonator tube element 34, through the central passage of the forward plate 48 and thence through the hollow core 36 of the resonator pipe element 34 and out through the central passage of the rearward plate 50, as indicated by the exhaust gas arrows G.

The essentially equal diameters 22 of the catalytic converter element 24 and inner surface of the forward portion 16 of the canister 12 serve to affix the catalytic converter element 24 concentrically within the canister 12. The tight fit of the catalytic converter element 24 within the forward portion 16 of the canister 12, provides a tight seal between the catalytic converter element 24 and forward portion 16 of the canister 12, thereby precluding any bypass flow of exhaust gases therebetween.

The toroidal plates 48 and 50 serve to secure the resonator pipe element 34 concentrically within the rearward portion 18 of the canister 12, with the tight fit of the catalytic converter element 24 within the forward portion 16 of the canister 12 serving to secure the converter element 24 concentrically therein. Thus, it will be seen that all of the above elements, i.e., the canister 12 with its inlet and outlet ends 14 and 20, catalytic converter 24, and resonator element 34 with its hollow core 36, are disposed concentrically relative to one another and are axially aligned with one another to provide a straight through, low restriction, free flow path for engine exhaust through the catalytic converter and resonator combination 10.

As noted further above, the resonator portion 34 of the present invention functions by attenuating sound of a predetermined frequency range, by means of the relatively small perforations 46 therethrough, and nearly all of the exhaust gases G pass through the resonator pipe hollow core 36. However, depending upon the relative pressures between the resonator core 36 and the resonator plenum 44, some exhaust gases may flow into the plenum 44. Accordingly, the rearward resonator attachment plate 50 may include one or more generally peripheral passages 54 therethrough, for allowing exhaust gases to depart the resonator plenum 44 and exit the canister 12 from the outlet end 20 thereof. The forward resonator attachment plate 48 may be formed with a solid periphery, to preclude the flow of exhaust gases from the converter and resonator plenum 52, directly into the resonator plenum 44.

As noted further above, resonators serve to attenuate sounds in only a relatively narrow band or range of frequencies, depending upon their construction. The range of frequencies damped by a given resonator, is primarily dependent upon the length of the internal resonator element or pipe therein, with shorter elements resulting in the control of relatively higher frequencies, and longer elements being adapted for the reduction of relatively lower frequencies. As the predominant frequencies emitted by a given internal combustion engine will be dependent upon the configuration of the engine, it will be seen that it is desirable to provide some means for adjusting a resonator configuration for a given installation. Such adjustability may be important even for different resonators to be used with identical engines in identical exhaust systems, but in different vehicles, due to different resonant qualities of the specific vehicle structure.

Figure 2:
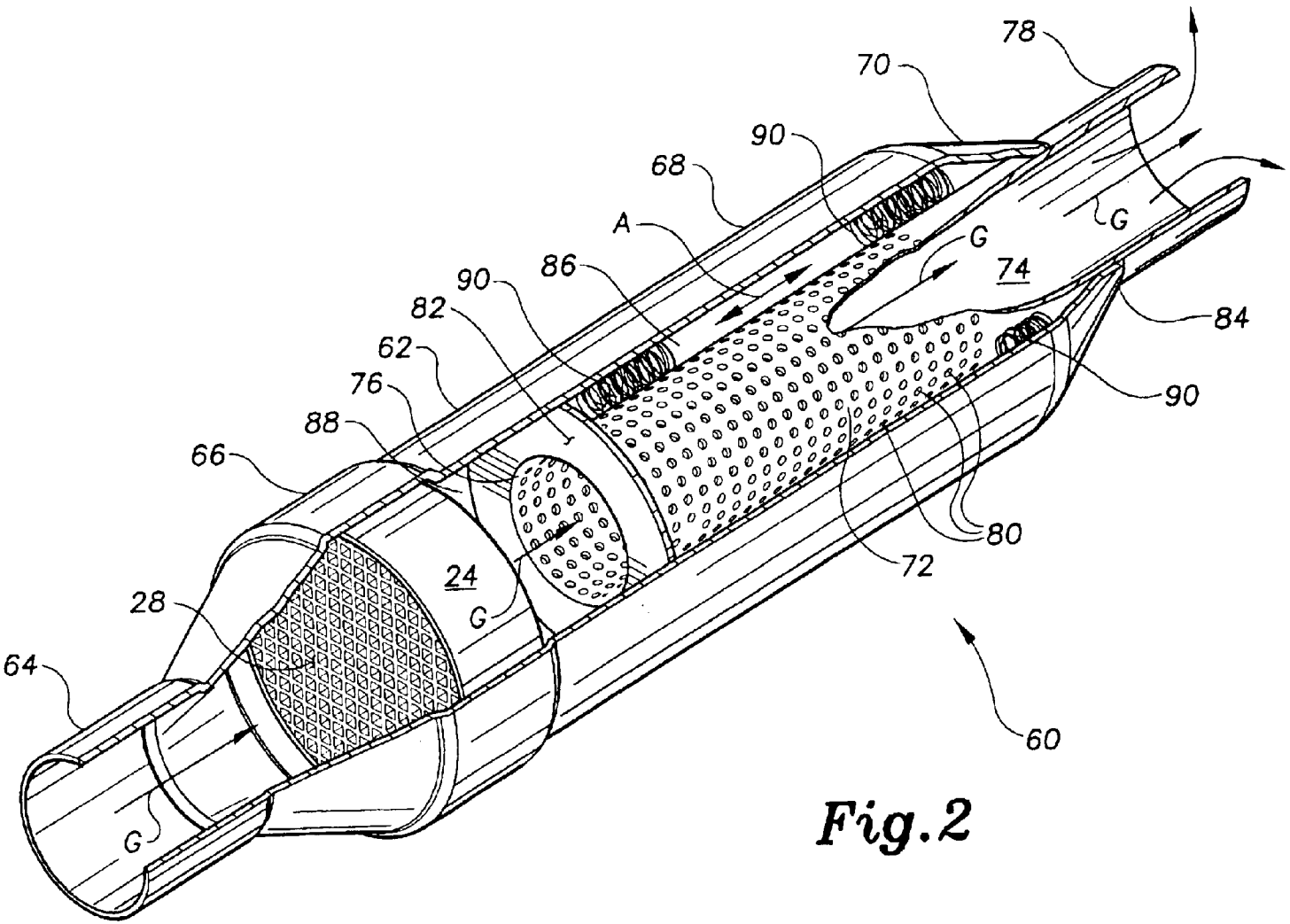
FIG. 2 is a perspective view in partial section of an alternative embodiment of the device of FIG. 1, showing the adjustability of the inner resonator tube during assembly for attenuating a predetermined range or band of sound frequencies, and including further sound absorbing materials therein.

Accordingly, the present invention provides for adjustment or tuning of the resonator frequency response band, by means of the combination catalytic converter and resonator 60 of FIG. 2. The converter and resonator combination 60 is constructed similarly to the converter and resonator combination 10 of FIG. 1, having a hollow, monolithic tubular canister or shell 62 with a forward or inlet end 64, a forward portion 66 immediately behind and adjacent the inlet end 64, and a rearward portion 68 immediately behind and adjacent the forward portion 66. However, the rearward portion 68 terminates in a conical section 70, which has a minor diameter equal to the diameter of the resonator element 72 therein.

The forward portion 66 is essentially identical to the forward portion 16 of the converter and resonator combination device 10 of FIG. 1, with the forward portion 66 being dimensioned to hold and secure at least one catalytic converter element 24 therein. The element 24 of the device 60 of FIG. 2 is identical to the element 24 of the device 10 of FIG. 1, having a substrate 28 with a plurality of longitudinal passages 30 therethrough defined by walls 32, as shown in detail in FIG. 6. The specific structural details and materials of the catalytic converter 24 have been discussed in detail further above in the discussion of the converter and resonator combination 10 embodiment of FIG. 1, and need not be repeated here.

The canister rearward portion 68 includes a resonator element 72 installed therein, constructed generally in the same manner as that described for the resonator element 34 of the embodiment 10 of FIG. 1. The resonator element 72 of the embodiment 68 of FIG. 2 has a hollow core 74, a forward end 76, and an opposite rearward end 78, which also comprises the rear or outlet pipe for the converter and resonator combination embodiment 60 of FIG. 2. The forward portion of the resonator element 72 is formed essentially identically to the resonator element 34 of the device 10 of FIG. 1, having a plurality of relatively small sound attenuating perforations or passages 80 formed through the wall thereof. The forward end 76 of the resonator 72 is secured concentrically within the canister rearward portion 68 by a forward plate 82.

It will be seen that the rear portion of the embodiment 60 of FIG. 2 differs from that of the embodiment 10 of FIG. 1, in that there is no need for a rearward resonator element support plate in the embodiment 60 of FIG. 2. As the resonator element 72 extends rearwardly from the rear conical portion 70 of the shell 62, the rear portion 78 of the element 72 is supported by the smaller diameter, necked down end portion 84 of the conical portion 70, and is welded at that joint to provide a leakproof seal at the time of manufacture or assembly. Accordingly, the rearward portion 78 of the resonator tube 72 is devoid of perforations, in order to provide a leakproof outlet for exhaust gases passing through the device 60 and onward to a trailing exhaust pipe (not shown) conventionally connected to the outlet end 78 of the resonator pipe element 72.

The remainder of the catalytic converter and resonator combination 60 of FIG. 2 is constructed similarly to the embodiment 10 of FIG. 1, with the resonator element 72 having an outer diameter substantially less than the inner diameter of the rear portion 68 of the canister 62. This difference between the inner diameter of the canister rearward portion 68 and the outer diameter of the resonator element 72, defines a sound attenuating plenum 86 therebetween. A forward sound attenuating plenum 88 is also defined between the rear of the catalytic converter element 24 and the forward end 76 of the resonator element 72 and its supporting front plate 82, within the outer shell 62 of the combination catalytic converter and resonator device 60.

The toroidal front plate 82, along with the necked down rearward end 84 of the conical rearward portion 70 of the shell 62, serve to secure the resonator pipe element 72 concentrically within the rearward portion 68 of the canister 62, with the tight fit of the catalytic converter element 24 within the forward portion 66 of the canister 62 serving to secure the converter element 24 concentrically therein. Thus, it will be seen that all of the above elements, i.e., the canister 62 with its inlet end 64 and necked down rearward end 84, catalytic converter 24, and resonator element 72 with its hollow core 74, are disposed concentrically relative to one another and are axially aligned with one another to provide a straight through, low restriction, free flow path for engine exhaust through the catalytic converter and resonator combination 60, essentially in the manner of the gas flow provided in the converter and resonator combination device 10 of FIG. 1.

Engine exhaust gases flow through the device 60 of FIG. 2 generally in the manner described for the exhaust gas flow through the converter and resonator 10 of FIG. 1, as indicated by the exhaust gas arrows G. While the small perforations 80 are adapted to attenuate sounds of a certain predetermined frequency range, it will be seen that some exhaust gases G will flow through these passages 80. However, this is of no consequence, because as gas pressure equalizes within the plenum 86 between the resonator element 72 and the outer shell 62, those gases will flow back through the resonator perforations 80 to be entrained in the exhaust gas flow G as it passes through the resonator element 72.

The above described construction for the combination catalytic converter and resonator combination 60 of FIG. 2, provides a means of adjusting the length of the resonator element 72 within the outer shell 62 of the device 60 during manufacture or assembly. The resonator forward end support plate 82 may be welded or otherwise suitably secured to the forward end 76 of the resonator element 72, and the assembly inserted into the outer shell 62 of the device 60 before the conical rearward end 70 is welded to the rearward end 68 of the outer shell or canister 62. At this point, the rearward conical end 70 is welded in place, with the rearward or outlet portion or end 78 of the resonator tube element 72 extending outwardly past the smaller diameter trailing end 84 of the rearward element 70 of the shell or canister 62.

It will be seen that at this point, the resonator element 72 and its attached forward end support plate 82 may be adjusted or repositioned as desired axially within the outer shell or canister 62, as indicated by the adjustment arrow A in FIG. 2. This allows the resonator element 72 to be positionally adjusted to a predetermined position as desired, in order to achieve the attenuation of sound within a certain predetermined frequency range. Extending the resonator element 72 rearwardly from the rearward portion 70 of the device 60 (with less of the element 72 residing within the plenum 86) results in the attenuation of relatively higher frequencies, while inserting the resonator element 72 into the interior of the shell 62 results in the attenuation of relatively lower frequencies.

The seam or joint defined by the smaller diameter rearward end 84 of the conical rearward end 70 of the outer shell or canister 62 and the unperforated end portion 78 of the resonator element 72, is then welded to provide a leakproof seal and to immovably affix the resonator element 72 in place. Thus, the catalytic converter and resonator combination device 60 of FIG. 2, may be adjustably tuned for each specific engine and vehicle application for which it is manufactured, in order to achieve the optimum sound attenuation in the frequency range desired.

While the above described adjustment of the resonator element 72 within the shell or canister 62 affects the attenuated frequency range of the device 60 to a great extent, it has very little, if any, effect on the volume of sound which emanates from the device 60. As there is no structure within the toroidal plenum 86 surrounding the resonator element 72, there may be a certain amount of sound which radiates from the resonator element 72, through the plenum 86, and outwardly through the walls of the outer shell or canister 62. Accordingly, the plenum volume 86 may be filled, at least to a certain degree as desired, with a sound absorbing material 90, in order to dampen the volume of sound which may emanate from the device 60. Such material may comprise glass fiber, corrosion resistant metal strands ("stainless steel wool"), spun fibers or strands of a rock or stone material such as basalt ("rock wool"), or other suitable material which is capable of retaining its structure when subjected to the high temperatures occurring within the present device 60.

Figure 3:
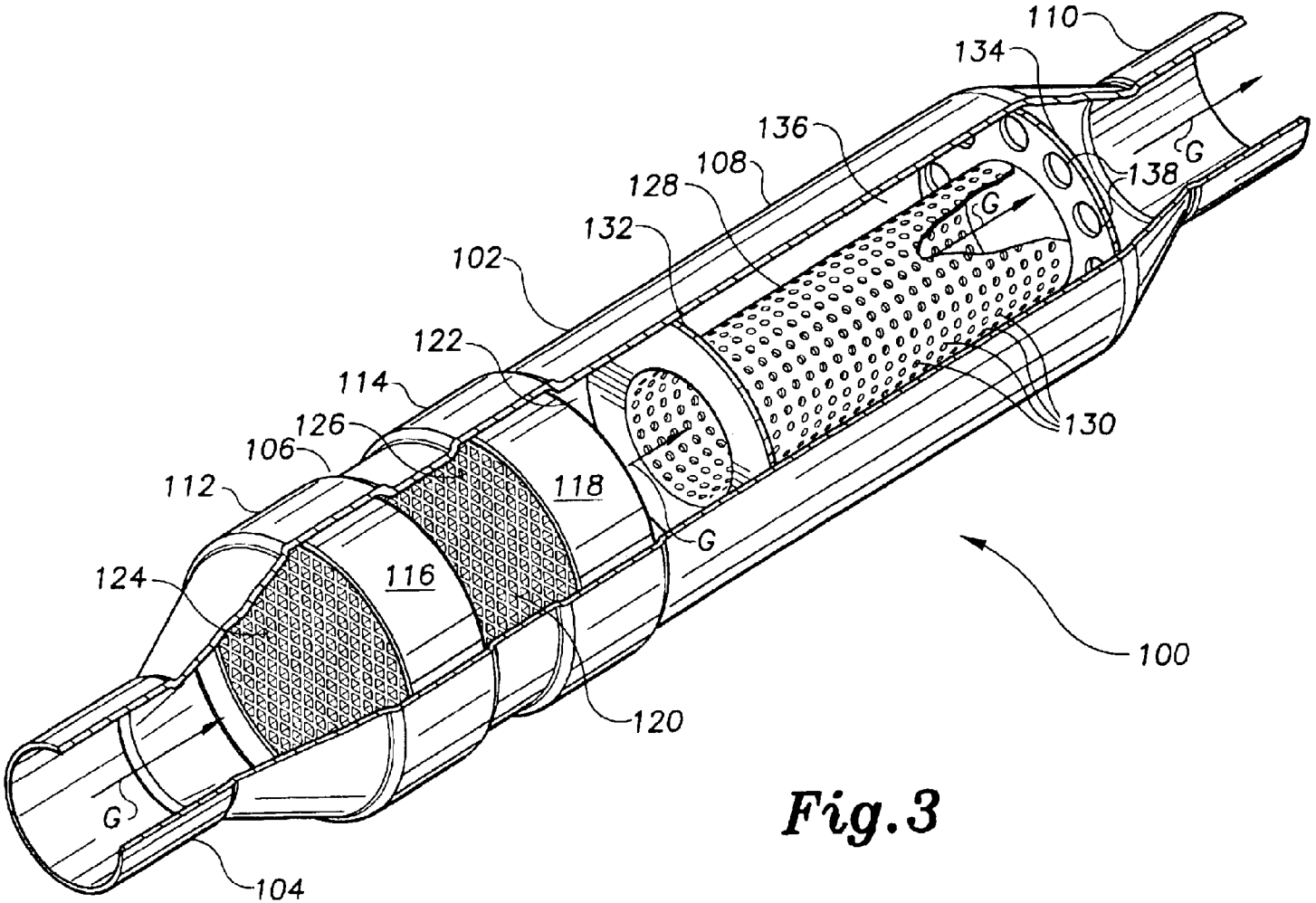
FIG. 3 is a perspective view in partial section of an alternative embodiment of the single exhaust catalytic converter and resonator combination of FIG. 1, incorporating dual concentric catalytic converter elements therein.

The above-described embodiments each include a single resonator tube element 34 or 72 with a single catalytic converter element 24 concentric therewith. However, it will be seen that additional catalytic converter elements may be added in series with the single element 24 of the devices 10 and 60 respectively of FIGS. 1 and 2, if so desired, for further efficiency. FIG. 3 discloses such an alternate embodiment, designated as catalytic converter and resonator combination 100.

The catalytic converter and resonator 100 is constructed generally along the lines of the converter and resonator 10 of FIG. 1, comprising a canister or shell 102 with an inlet end 104, forward portion 106, rearward portion 108, and outlet end 110. The canister forward portion 106 is actually divided into two separate portions, respectively 112 and 114, each having a catalytic converter, respectively 116 and 118, affixed therein, with each sealed about its periphery in the manner of the single catalytic converter 24 within the forward portion 16 of the converter and resonator combination 10 of FIG. 1. The two catalytic converter elements 116 and 118 may be spaced apart by a catalytic converter plenum 120 disposed therebetween, if desired. Alternatively, the two converters 116 and 118 may be positioned immediately adjacent one another, in order to transfer heat generated by the catalytic reactions therein to one another for greater efficiency. A catalytic converter and resonator plenum 122 may be provided behind the second converter 118, in the manner of the converter and resonator plenum 52 of the converter and resonator 10 of FIG. 1.

Figure 5:
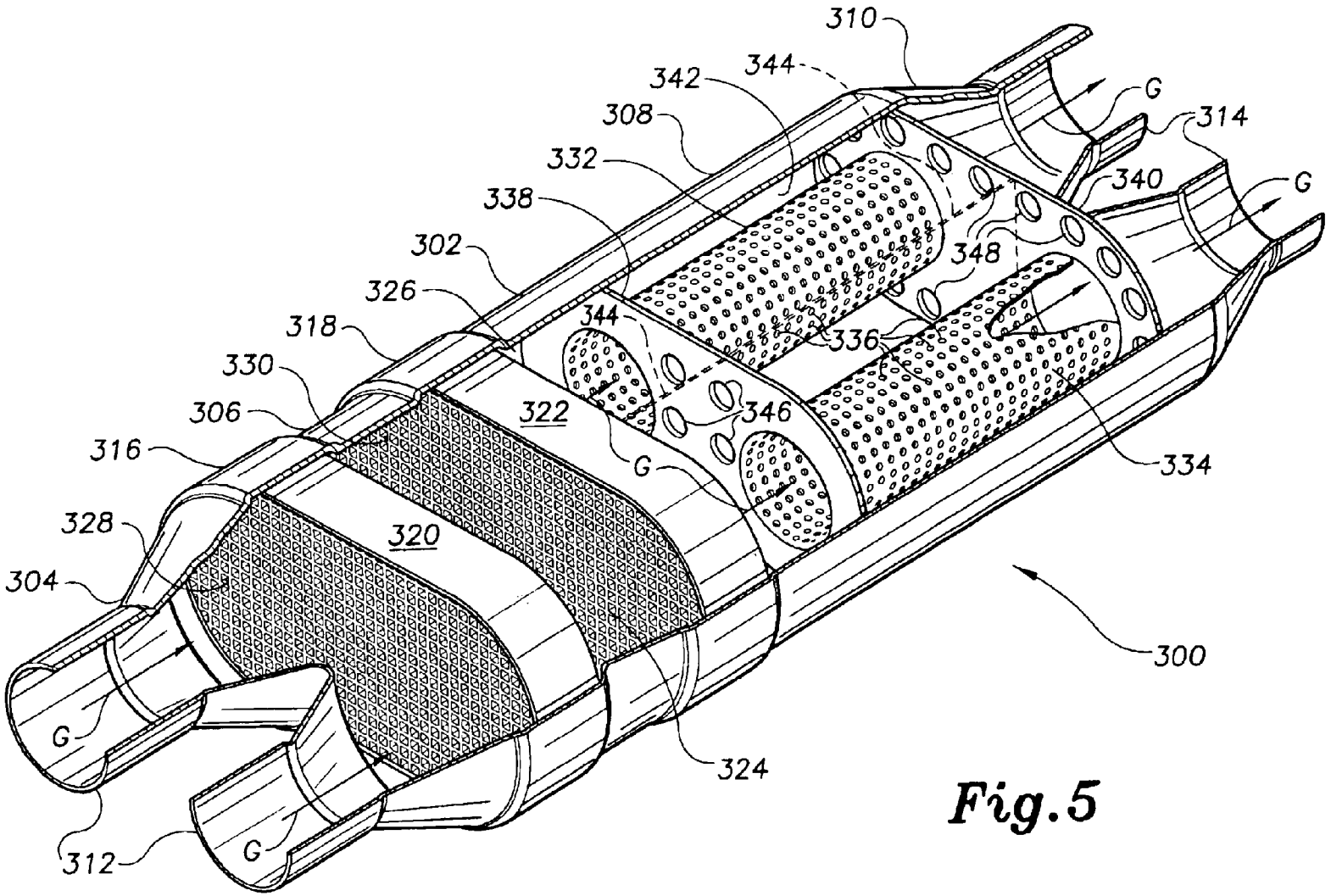
FIG. 5 is a perspective view in partial section of an alternative embodiment of the device of FIG. 4, incorporating dual concentric catalytic converter elements therein.

Each of the catalytic converter elements 116 and 118 includes a substrate, respectively 124 and 126. These two substrates 124 and 126 are preferably formed in the manner described further above for the substrate 28 of the catalytic converter 24 of FIG. 1, i.e., having relatively thin walls and relatively large passage widths therebetween, as illustrated in FIG. 5. A ceramic material, such as the Dow-Corning XT described further above, may be used to form the substrates 124 and 126 of the embodiment 100 of FIG. 2. If desired, the two substrates 124 and 126 may utilize different coatings or washes of catalytic materials or elements thereon, and/or in different concentrations, in order to catalyze different exhaust products to differing degrees in each of the two converters 116 and 118. It will be seen that additional catalytic converter elements, not shown, may be placed in series with the two catalytic converter elements 116 and 118 of the catalytic converter and resonator combination 100 of FIG. 3, if so desired, for further efficiency in processing exhaust emissions.

The rearward portion 108 of the canister 102 contains an axially concentric resonator tube or pipe element 128 having a plurality of noise attenuating perforations 130 therein. The resonator element 128 is affixed within the canister rearward portion 108 by a forward and a rearward toroidal plate, respectively 132 and 134, as in the converter and resonator combination 10 of FIG. 1. A resonator plenum 136 is defined between the resonator element 128 and the canister rearward portion 108, similar to the equivalent construction shown in FIG. 1.

As in the catalytic converter and resonator combination 10 of FIG. 1, the forward resonator tube retaining plate 132 is preferably formed with a solid, impermeable periphery, to preclude exhaust gases from flowing directly into the resonator plenum 136 from the catalytic converter and resonator plenum 122. However, the rear retaining plate 134 may be provided with a series of peripheral passages 138 therethrough, in the manner of the rear plate 50 of the converter and resonator combination 10 of FIG. 1, in order to allow any small amount of gases passing into the resonator plenum 136 to escape therefrom.

The catalytic converter and resonator combination 100 of FIG. 3 functions essentially like the converter and resonator 10 of FIG. 1, with exhaust gases G entering the canister 102 through the inlet end 104, and thence passing through the two catalytic converters 116 and 118. The converters 116 and 118 (and/or others) serve to react the exhaust gases G catalytically, whereupon the gases G pass into the catalytic converter and resonator plenum 122 and rearwardly through the resonator element 128. The noise level of the exhaust is canceled or attenuated in a frequency range (generally relatively higher frequencies) according to the spacing and dimensions of the perforations 130 of the resonator element 128. The gases G then exit the catalytic converter and resonator combination 100 from the rear or outlet end 110 of the canister 102, to pass into the remainder of the exhaust system.

Figure 4:
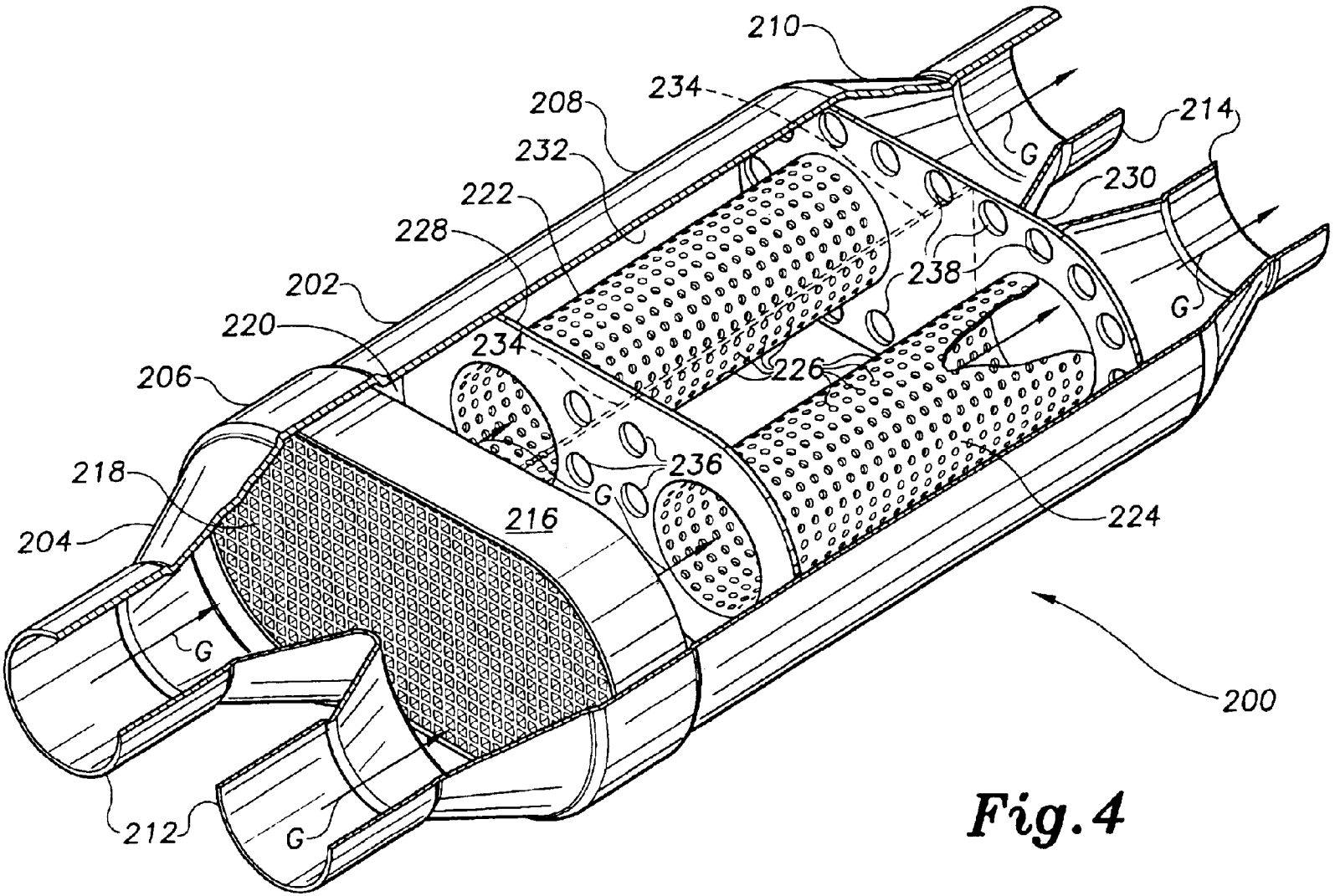
FIG. 4 is a perspective view in partial section of another alternative catalytic converter and resonator combination, with two side-by-side resonators behind a single catalytic converter.

FIGS. 4 and 5 illustrate two further embodiments of the present invention, for dual exhaust systems having a pair of inlet pipes and a corresponding pair of outlet pipes. The catalytic converter and resonator of FIG. 4, designated by the reference numeral 200, will be seen to have a single catalytic converter element therein, but includes a pair of resonator elements. The catalytic converter and resonator 200 is constructed somewhat along the lines of the converter and resonator 10 of FIG. 1, comprising a canister or shell 202 with an inlet end 204, forward portion 206, rearward portion 208, and outlet end 210. However, it will be seen that the inlet and outlet ends 204 and 210 each respectively comprise a pair of laterally joined, truncated, conically shaped shells blending together to smoothly join the oval shaped canister portion 202. The inlet and outlet ends 204 and 210 each have a pair of cylindrical inlet and outlet pipes, respectively 212 and 214, extending therefrom. These twin inlet and outlet pipes 212 and 214 allow the catalytic converter and resonator combination 200 of FIG. 4, to be installed in a dual exhaust system.

The catalytic converter element 216 of the converter and resonator combination 200 of FIG. 4, will be seen to have an oval configuration closely fitting within and sealed to the forward portion 206 of the converter and resonator canister 202. Thus, exhaust gases cannot pass between the inner wall of the canister 202 shell and the outer wall of the catalytic converter element 216, but must pass through the substrate 218, as in the manner of the other embodiments.

The substrate 218 of the catalytic converter element 216 is preferably constructed similarly to the substrates 28, 124, and 126 of the converter and resonator devices 10 and 100 discussed further above, i.e., preferably formed of a ceramic material such as the Dow-Corning XT described above, with relatively thin walls to allow the substrate to heat rapidly for maximum efficiency, and with relatively wide passages (preferably greater than 0.040 inch) therethrough for reducing exhaust gas flow restriction as much as possible. A catalytic converter and resonator plenum 220 may be provided behind the converter element 216, in the manner of the converter and resonator plenum 52 of the converter and resonator 10 of FIG. 1.

The canister rearward portion 208 contains first and second laterally spaced, axially concentric resonator pipe elements, respectively 222 and 224, each having a plurality of noise attenuating perforations 226 therein. The resonator elements 222 and 224 are affixed within the canister rearward portion 208 by a forward and a rearward plate, respectively 228 and 230, as in the converter and resonator combination 10 of FIG. 1. Instead of the toroid shaped plates of the catalytic converter and resonator combinations 10 and 100 of FIGS. 1 and 3, the two plates 228 and 230 each have an oval peripheral shape, to fit closely within the oval shaped canister 202. Each plate 228 and 230 includes a pair of laterally spaced apart resonator passages therethrough, for exhaust gases to pass from the converter and resonator plenum 220 into the two resonator elements 222 and 224, and from the resonator elements 222 and 224, into the canister outlet portion 210.

A resonator sound attenuating plenum 232 is defined between the first and second resonator elements 222 and 224 and the canister rearward portion 208, similar to the equivalent construction shown in FIG. 1. The plenum 232 of the converter and resonator combination 200 of FIG. 4 serves essentially the same function as the plenum 44 of the device 10 of FIG. 1, i.e., to attenuate exhaust noise or sound of a predetermined frequency range, before the exhaust gases leave the device. However, it will be noted that the plenum 232 of the device of FIG. 4 is somewhat larger than that of the other two converter and resonator combination devices 10 and 100 described further above, since the surrounding canister 202 does not encircle only a single resonator element.

The resulting relatively large plenum 232 may be desirable, with pressure waves from the two resonator elements 222 and 224 perhaps canceling one another in the central area of the plenum 232 between the two resonator tubes 222 and 224. However, it is possible that amplification of certain frequencies might also occur under certain conditions, and accordingly, it may be desirable to divide the single large plenum 232 with a longitudinal baffle 234 (shown as an optional component, in broken lines in FIG. 4) in order to separate the two resonator elements 222 and 224. The baffle 234 may extend forwardly of the forward resonator attachment plate 228, if so desired, to divide the converter and resonator plenum as well.

The forward resonator tube retaining plate 228 may be formed with a solid, impermeable periphery, as in the catalytic converter and resonator combination 10 of FIG. 1. However, an alternative is shown in the converter and resonator embodiment 200 of FIG. 4, in which both the front and rear plates 228 and 230 include a plurality of peripheral passages, respectively 236 and 238, therethrough, in the manner of the rear plate 50 of the converter and resonator combination 10 of FIG. 1, in order to allow any small amount of gases passing into the resonator plenum 232 to escape therefrom.

The catalytic converter and resonator combination 200 of FIG. 4 functions essentially like the converter and resonator 10 of FIG. 1, with exhaust gases G entering the canister 202 through the dual inlet pipes 212 of the inlet end 204, and thence passing through the single catalytic converter element 216. (While the single oval shaped converter element 216 is generally shaped to fit more conventional catalytic converters, it will be seen that the dual resonator embodiment 200 of FIG. 4 could be constructed with the forward portion 206 of the canister 202 configured with two adjacent cylindrically shaped areas, to accept two laterally spaced cylindrical converter elements configured somewhat like the converter elements 24, 116, and 118 of FIGS. 1 and 2, if so desired.)

The converter element 216 serves to react the exhaust gases G catalytically, whereupon the gases G pass into the catalytic converter and resonator plenum 220 and rearwardly through the two resonator elements 222 and 224. The noise level of the exhaust is canceled or attenuated in a frequency range (generally relatively higher frequencies) according to the spacing and dimensions of the perforations 226 of the two resonator elements 222 and 224, and the installation of a dividing baffle 234 (if any) therebetween. The gases G then exit the catalytic converter and resonator combination 200 from the rear or outlet end 210 and corresponding outlet pipes 214 of the canister 202, to pass into the remainder of the exhaust system.

The axially parallel configuration of the inlet pipes 212, substrate passages of the catalytic converter element 216, dual resonator elements 222 and 224, and outlet pipes 214, serve to provide the least possible change of direction for exhaust gases G flowing through the catalytic converter and resonator combination 200 of FIG. 4. In fact, other than some mixing and expansion which may occur in the plenums of the device 200 of FIG. 4, the components of the two basic exhaust gas passages defined by each corresponding inlet and outlet pipe 212 and 214, are precisely axially aligned with one another. Preferably, the canister shell 202, resonator elements 222 and 224, forward and rearward resonator attachment plates 228 and 230, and longitudinal resonator plenum baffle 234 (if installed) are all formed of corrosion resistant (stainless) steel, although other materials may be used if desired.

The catalytic converter and resonator combination embodiment 300 of FIG. 5, will be seen to be similar to the converter and resonator combination embodiment 200 illustrated in FIG. 4 and discussed above, and closely related to the catalytic converter and resonator combination embodiments 10, 60, and 100, respectively of FIGS. 1, 2, and 3. However, rather than having only a single oval shaped converter element installed in the forward portion of the canister, the converter and resonator combination 300 of FIG. 5 includes a pair of catalytic converter elements in tandem, somewhat along the lines of the catalytic converter and resonator combination device 100 illustrated in FIG. 3.

The catalytic converter and resonator 300 is constructed somewhat along the lines of the converter and resonator 200 of FIG. 4, comprising a generally oval shaped canister or shell 302 with an inlet end 304, forward portion 306, rearward portion 308, and outlet end 310. However, it will be seen that the inlet and outlet ends 304 and 310 each respectively comprise a pair of laterally joined, truncated, conically shaped shells blending together to smoothly join the oval shaped canister portion 302. The inlet and outlet ends 304 and 310 each have a pair of cylindrical inlet and outlet pipes, respectively 312 and 314, extending therefrom. These twin inlet and outlet pipes 312 and 314 allow the catalytic converter and resonator combination 300 of FIG. 5, to be installed in a dual exhaust system.

Rather than the single catalytic converter elements 24 and 216 of the converter and resonator combination embodiments 10, 60, and 200 respectively of FIGS. 1, 2, and 4, the canister forward portion 306 of the catalytic converter and resonator combination 300 of FIG. 5 is actually divided into two separate portions, respectively 316 and 318, each having a catalytic converter element, respectively 320 and 322, affixed therein. Each catalytic converter element 320 and 322 is sealed about its periphery in the manner of the single catalytic converter 24 within the forward portion 16 of the converter and resonator combination 10 of FIG. 1, and other embodiments discussed further above.

The two catalytic converter elements 320 and 322 may be spaced apart by a catalytic converter plenum 324 disposed therebetween, if desired. Alternatively, the two converters 320 and 322 may be positioned immediately adjacent one another, in order to transfer heat generated by the catalytic reactions therein to one another for greater efficiency. A catalytic converter and resonator plenum 326 may be provided behind the second converter 324, in the manner of the converter and resonator plenum 52 of the converter and resonator 10 of FIG. 1.

It will be seen that the catalytic converter and resonator combination embodiment 300 of FIG. 5 may be constructed to have a greater length for the inclusion of additional catalytic converter elements (not shown), if desired, in a similar manner to the alternative construction of the catalytic converter and resonator combination 100 of FIG. 3, discussed further above.

Each catalytic converter element 320 and 322 includes a substrate, respectively 328 and 330. These two substrates 328 and 330 are preferably formed in the manner described further above for the substrate 28 of the catalytic converter 24 of FIG. 1, i.e., having relatively thin walls and relatively large passage widths therebetween, as illustrated in FIG. 6. A ceramic material, such as the Dow-Corning XT described further above, may be used to form the substrates 328 and 330 of the embodiment 300 of FIG. 5. If desired, the two substrates 328 and 330 may utilize different coatings or washes of catalytic materials or elements thereon, and/or in different concentrations, in order to catalyze different exhaust products to differing degrees in each of the two converters 320 and 322. As noted further above, additional catalytic converter elements, not shown, may be placed in series with the two catalytic converter elements 320 and 322 of the catalytic converter and resonator combination 300 of FIG. 5, if so desired, for further efficiency in processing exhaust emissions.

The two catalytic converter elements 320 and 322 of the converter and resonator combination 300 of FIG. 5, each have an oval configuration closely fitting within and sealed respectively within the first and second catalytic converter portions 316 and 318 of the converter and resonator canister 302. Thus, exhaust gases cannot pass between the inner wall of the canister 302 shell and the outer walls of the two catalytic converter elements 320 and 322, but must pass through the respective substrates 328 and 330, as in the manner of the other embodiments.

The two substrate elements 328 and 330 of the respective catalytic converter elements 320 and 322 are preferably constructed similarly to the substrates 28, 124, 126, and 218 of the converter and resonator devices 10, 60, 100, and 200 discussed further above, i.e., preferably formed of a ceramic material such as Dow-Corning XT (tm), with relatively thin walls to allow the substrate to heat rapidly for maximum efficiency, and with relatively wide passages (preferably greater than 0.040 inch) therethrough for reducing exhaust gas flow restriction as much as possible.

The canister rearward portion 308 contains first and second laterally spaced, axially concentric resonator pipe elements, respectively 332 and 334, each having a plurality of noise attenuating perforations 336 therein. The resonator elements 332 and 334 are affixed within the canister rearward portion 308 by a forward and a rearward plate, respectively 338 and 340, as in the converter and resonator combination 200 of FIG. 4, and others. Instead of the toroid shaped plates of the catalytic converter and resonator combinations 10, 60, and 100 respectively of FIGS. 1, 2, and 3, the two plates 338 and 340 each have an oval peripheral shape, to fit closely within the oval shaped canister 302. Each plate 338 and 340 includes a pair of laterally spaced apart resonator passages therethrough, for exhaust gases to pass from the converter and resonator plenum 326 into the two resonator elements 332 and 334, and from the resonator elements 332 and 334, into the canister outlet portion 310.

A resonator sound attenuating plenum 342 is defined between the first and second resonator elements 332 and 334 and the canister rearward portion 308, similar to the equivalent construction shown in FIG. 3. The plenum 342 of the converter and resonator combination 300 of FIG. 5 serves essentially the same function as the plenum 232 of the device 200 of FIG. 4, i.e., to attenuate exhaust noise or sound of a predetermined frequency range, before the exhaust gases leave the device. The plenum 342 of the device of FIG. 5 is configured much the same as the plenum 232 of the converter and resonator combination 200 of FIG. 4, due to the similar configuration of the remainder of the two devices. A longitudinal baffle 344 (shown optionally, in broken lines) may be installed between the two resonator elements 332 and 334 to divide the single large plenum 342, in the manner and for the purposes of the optional baffle 234 of the catalytic converter and resonator combination 200 shown in FIG. 4.

The forward resonator tube retaining plate 338 may be formed with a solid, impermeable periphery, as in the catalytic converter and resonator combination 10 of FIG. 1. However, an alternative is shown in the converter and resonator embodiment 300 of FIG. 5, in which both the front and rear plates 338 and 340 include a plurality of peripheral passages, respectively 346 and 348, therethrough, in the manner of the rear plate 50 of the converter and resonator combination 10 of FIG. 1, in order to allow any small amount of gases passing into the resonator plenum 342 to escape therefrom.

The catalytic converter and resonator combination 300 of FIG. 5 functions essentially like the converter and resonator 100 of FIG. 3, with exhaust gases G entering the canister 302 through the dual inlet pipes 312 of the inlet end 304, and thence passing through the two catalytic converter elements 320 and 322. (While the two oval shaped converter elements 320 and 322 are generally shaped to fit more conventional catalytic converters, it will be seen that the dual resonator embodiment 300 of FIG. 5 could be constructed with the forward portion 306 of the canister 302 configured with two adjacent cylindrically shaped areas, to accept two laterally spaced cylindrical converter elements configured somewhat like the converter elements 24, 116, and 118 of FIGS. 1 and 3, if so desired.)

The converter elements 320 and 322 serve to react the exhaust gases G catalytically, whereupon the gases G pass into the catalytic converter and resonator plenum 326 and rearwardly through the two resonator elements 332 and 334. The noise level of the exhaust is canceled or attenuated in a frequency range (generally relatively higher frequencies) according to the spacing and dimensions of the perforations 336 of the two resonator elements 332 and 334, and the installation of a dividing baffle 344 (if any) therebetween. The gases G then exit the catalytic converter and resonator combination 300 from the rear or outlet end 310 and corresponding outlet pipes 314 of the canister 302, to pass into the remainder of the exhaust system.

The axially parallel configuration of the inlet pipes 312, substrate passages of the two catalytic converter elements 320 and 322, dual resonator elements 332 and 334, and outlet pipes 314, provide the least possible change of direction for exhaust gases G flowing through the catalytic converter and resonator combination 300 of FIG. 5. In fact, other than some mixing and expansion which may occur in the plenums of the device 300 of FIG. 5, the components of the two basic exhaust gas passages defined by each corresponding inlet and outlet pipe 312 and 314, are precisely axially aligned with one another. As in the case of the other embodiments discussed further above, various sheet metal components are preferably formed of corrosion resistant (stainless) steel, although other materials may be used if desired.

A test of one of the dual resonator embodiments of the present catalytic converter and resonator combination was performed on Aug. 12, 1997, to measure the exhaust emissions from an engine E to which the present invention was connected. (Comparable results would be expected from the other embodiments when installed in a compatible exhaust system.) Testing was performed on an automobile (1992 Marocco) using an engine from a 1992 Chevrolet Corvette, with the engine meeting the emissions regulations for that model year. The test configuration was somewhat along the lines of the assembly shown in FIG. 8, with the converter and resonator combination, e.g., embodiment 300, being connected to the exhaust system of an engine E, somewhat downstream of the engine E in the general location of a conventional resonator installation.

Figure 8:
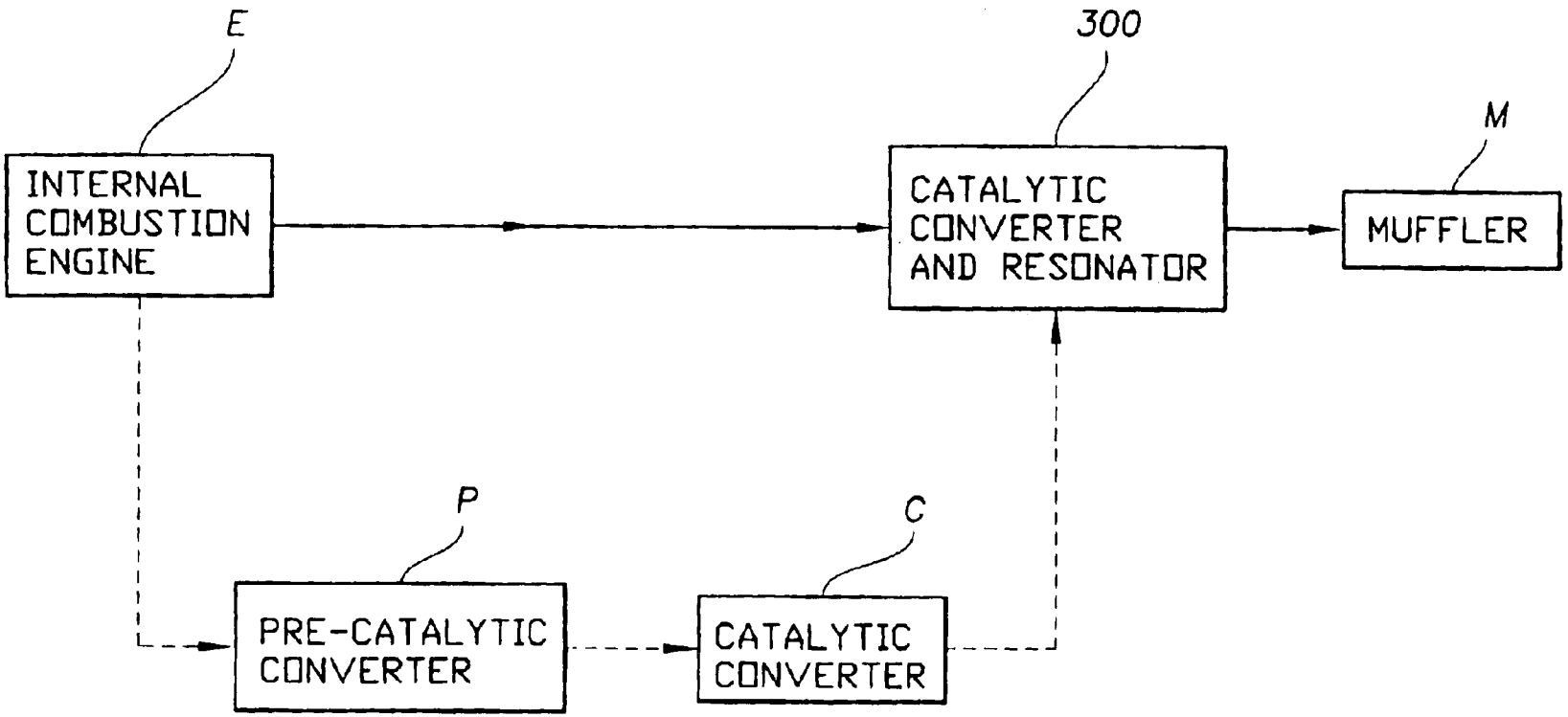
FIG. 8 is a flow chart showing the preferred installation of the present catalytic converter and resonator combination in an exhaust system.

A muffler M was installed at the downstream end of the system. While a conventional pre-catalytic P and catalytic converter C are shown in FIG. 8, it should be noted that these two components are not necessarily required with the present catalytic converter and resonator combination in any of its embodiments, but may be installed therewith if so desired or required. While the muffler M may be desirable for further noise reduction, it should be noted that the combination of the present catalytic converter and resonator, with either a pre-catalytic converter and/or another catalytic converter, may obviate need for further noise reduction means, particularly if additional sound absorbent material is installed. Test results are provided in Table I, following.

TABLE I

EXHAUST EMISSIONS TEST RESULTS

| | TOTAL HYDROCARBONS | CARBON MONOXIDE | OXIDES OF NITROGEN | NON-METHANE HYDROCARBONS |
|---|---|---|---|---|
| 1992 CALIF. AIR RESOURCES BOARD STANDARDS (grams/mile) | 0.41 | 3.40 | 1.00 | (Not tested in 1992) |
| LOW EMISSIONS VEHICLE | 0.41 | 3.40 | 0.20 | 0.075 |
| ULTRA LOW EMISSIONS VEHICLE | 0.41 | 1.70 | 0.20 | 0.040 |
| 1992 CORVETTE | 0.33 | 1.82 | 0.63 | (Not tested in 1992) |
| 1992 MAROCCO, CATALYTIC CONVERTER AND RESONATOR (90 seconds to closed loop) | 0.08 | 0.58 | 0.63 | 0.069 |

It should be noted that the 1992 Marocco is an exotic, high performance automobile which uses the engine and drivetrain components from a 1992 Chevrolet Corvette, including the six speed manual transmission of that drivetrain. This transmission includes a "skip shift" pattern which electronically induces a second gear lockout when the car is shifted from first gear at relatively low throttle openings and engine speed, in order to meet the CAFE (Corporate Average Fuel Economy) requirements without penalty. Thus, the transmission is shifted from first to fourth gear, rather than being sequentially shifted from first to second gear.

However, the above noted test results for the 1992 Corvette did not use the skipped shift pattern during the time the engine was not fully warm, but rather used a sequential shift pattern. The 1992 Marocco utilized the skipped shift pattern, going from first directly to fourth gear, throughout this test. It appears that this may be the reason for the difference in the time required for the engines in the respective cars to warm to the "closed loop" emissions control program. Further testing is planned in order to check this factor.

Another factor in the above test was an additional catalytic converter component installed on the 1992 Marocco car, comprising a combination pre-catalytic converter and catalytic converter device. An exhaust and emissions system engineer was consulted and found that the present catalytic converter and resonator combination was responsible for about 30 percent of the reduction in emissions of the car. Thus, factoring out the approximately 70 percent emissions reduction due to the pre-catalytic converter and catalytic converter combination installed on the 1992 Marocco, would result in total hydrocarbon and carbon monoxide emissions respectively of 0.27 and 1.67 grams/mile, which still betters both the 1992 Corvette emissions test results and the ultra low emissions vehicle standards.

Although the test standards did not allow the 1992 Marocco car equipped with the present catalytic converter and resonator combination to be measured by the same standards as the 1992 Corvette, it should be noted that with the exception of the oxides of nitrogen and non-methane hydrocarbon emission components, the system meets or exceeds the standards for ultra-low emissions vehicles planned for the future. Also, even though the testing of the 1992 Marocco was not conducted to the same standards as that of the 1992 Corvette, the 1992 Marocco equipped with the present catalytic converter and resonator combination, bettered the exhaust emissions measured from the 1992 Corvette for total hydrocarbons and carbon monoxide, even when factoring out emissions reductions due to other emissions control devices installed on the 1992 Marocco automobile.

To summarize the discussion of the first series of embodiments of FIGS. 1 through 8, the catalytic converter and resonator combination of the present invention result in superior exhaust emissions control for an internal combustion engine. The installation of one or more catalytic converter elements with one or more resonator pipe elements, in the area where such systems are typically installed along the mid portion of an automobile exhaust system, results in the catalytic converter element(s) receiving sufficient exhaust heat to provide significant reductions in exhaust emissions, while simultaneously controlling noise with the resonator component. The device of FIGS. 1–8 may be used with other exhaust emissions and noise control devices, or may be used as a stand alone system, pending testing which may find that further emissions and sound controls are not required on certain automobiles and engines.

The present catalytic converter and resonator combination in any of its embodiments may also be constructed to provide for the adjustment or tuning of the resonator element within the outer shell or canister, at the time of manufacture or assembly. In this manner, the combination may be tuned to a predetermined configuration in order for the resonator to attenuate exhaust sounds in a predetermined frequency range as desired, to suit specific engine and/or vehicle configurations. Also, any of the embodiments described above may be provided with some form of sound insulation material disposed within the plenum surrounding the resonator element(s), in order to attenuate the volume of exhaust sound emanating from the device.

The use of a strong and durable material which is capable of withstanding extremely high temperatures, enables the substrates of the present catalytic converter components to be constructed with thinner walls, and thus larger passages therethrough, to reduce restrictions to exhaust gas flow through the components. The relatively thin walls of the substrates, with their relatively high surface area to mass and volume ratios, allow them to heat up more quickly to achieve further gains in catalytic reaction efficiency. The effect of the present catalytic converter and resonator combination, in any of its embodiments, enables essentially conventional internal combustion engines to meet or exceed the standards set for ultra low emissions vehicles, and will result in a cleaner, healthier environment when motor vehicles are equipped with the system of the present invention.

The exhaust sound attenuation and control system of FIGS. 9 through 16 comprises various embodiments of an exhaust system for attenuating the sound, and optionally treating the emissions, of an internal combustion engine. The present exhaust system is more than just a muffler, and combines aspects of a muffler with aspects of a resonator unit as well. Optionally, the present system may incorporate catalytic materials for emissions treatment of the exhaust gases flowing therethrough. Thus, the present exhaust treatment system provides a more compact, lighter weight, and more economical device for treating and controlling sound and other emissions of the exhaust of an internal combustion engine, replacing the multiple units required by conventional exhaust systems.

Figure 9:
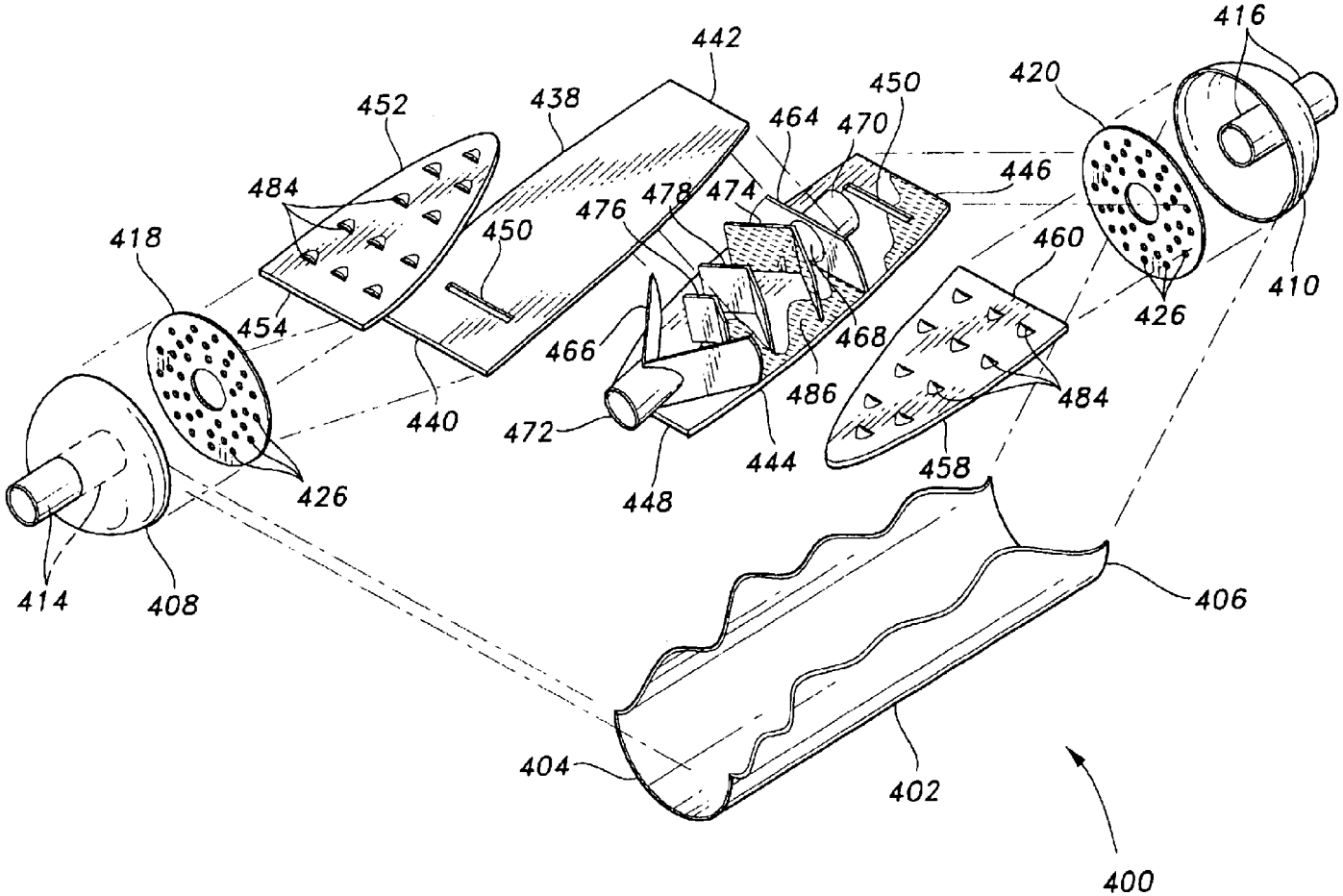
FIG. 9 is an exploded perspective view of an exhaust sound attenuation and control system according to the present invention, showing its components and their relationship to one another.
Figure 10:
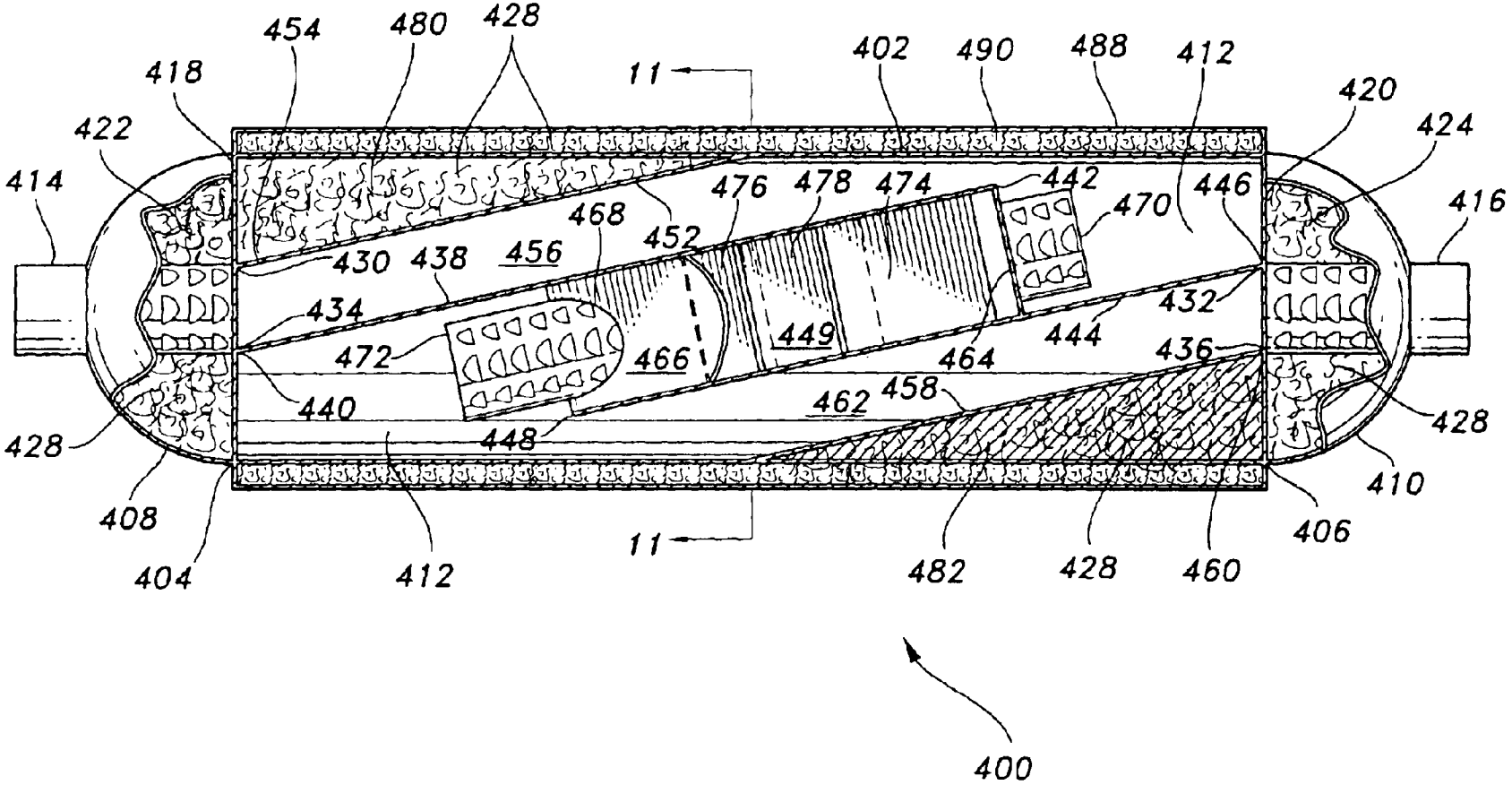
FIG. 10 is an elevation view in section of an alternative embodiment of the assembled exhaust system of FIG. 9, showing further details thereof and the flow path through the device.
Figure 11:
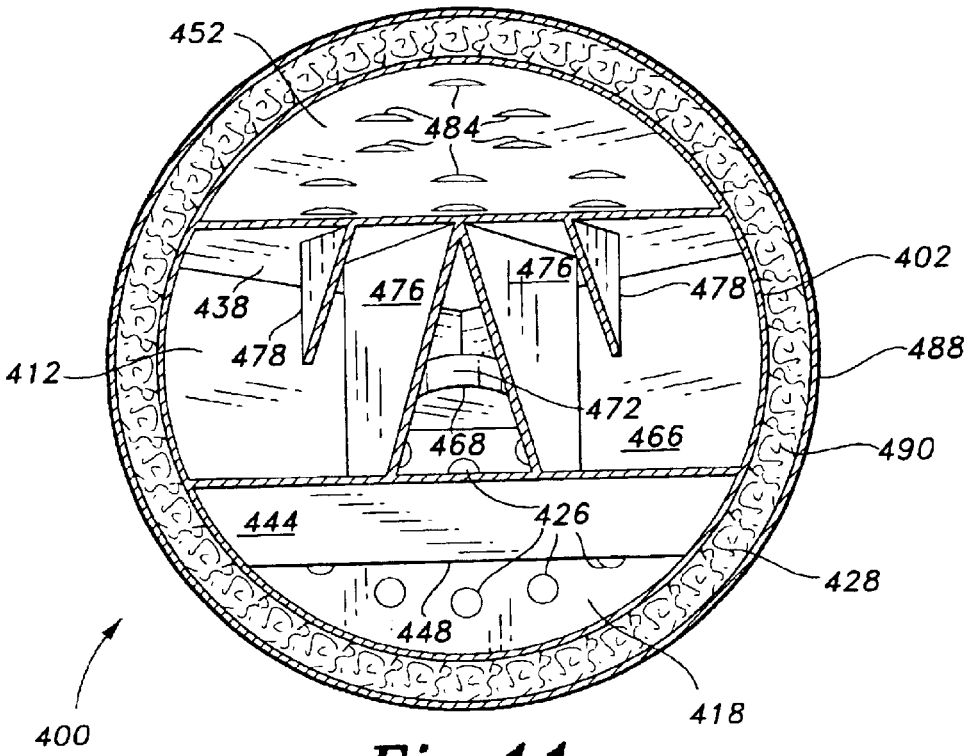
FIG. 11 is an elevation view in section of the exhaust system of FIG. 10, along line 11—11 of FIG. 10.

FIGS. 9 through 11 of the drawings provide exploded perspective and sectional views of a first embodiment 400 of the present exhaust system, comprising a generally cylindrical unit. The internal components of the exhaust system 400 are enclosed in an elongate external housing or shell 402 (shown with one side broken away in FIG. 9, for clarity in the drawing FIG.) having an inlet end 404 and opposite outlet end 406. Each end 404 and 406 of the housing 402 has an end plate sealed thereto, respectively inlet end plate 408 and outlet end plate 410. These end plates 408 and 410 may comprise convex hemispherical shells, as shown, or may be flat or have some other shape, as desired. The additional internal volume of the illustrated convex hemispherical end plates 408 and 410 may provide additional benefits, as discussed further below.

The external housing 402, inlet end plate 408, and outlet end plate 410 define an internal volume 412 (indicated in FIGS. 10 and 11) which is sealed from the outer environment except for their respective inlet pipe 414 and outlet pipe 416. In the case of the hemispherical inlet and outlet plates 408 and 410, the inlet and outlet pipes 414 and 416 preferably penetrate their respective inlet and outlet plates 408 and 410 to exit through the centers of inlet and outlet internal end plates, respectively 418 and 420. These internal end plates 418 and 420 define respective inlet and outlet end volumes 422 and 424, which may provide additional benefits in the treatment of the exhaust gases passing through the present system.

Each of the internal end plates 418 and 420 may include a series of perforations 426 therethrough, which allow exhaust gases to circulate into the inlet and outlet end volumes 422 and 424 of the system. These end volumes 422 and 424 may include some form of sound absorbent material 428 installed therein (shown in FIG. 10, e.g., glass fiber roving, etc.) to provide additional sound control, depending upon the sound level output of the engine, the size and sound control attributes of the remainder of the system, and the sound output level and quality desired. It will also be seen that the internal end plates 418 and 420 may be made considerably longer or thicker than shown in the drawings, and with their passages or perforations 426 coated internally with a catalytically reactive material, may provide a significant catalytic conversion effect when the system is modified to provide a net exhaust flow through the end volumes 422 and 424.

While FIG. 9 illustrates the various components which comprise the present exhaust system 400, FIG. 10 provides an illustration of the exhaust gas flow paths which pass through the system 400. For the sake of reference to the installation positions of the various internal panels, plates, and baffles comprising the internal structure of the device 400, the inlet and exhaust pipes 414 and 416 are considered to have a first side, respectively 430 and 432, and an opposite second side, respectively 434 and 436, indicated in FIG. 10 of the drawings. The diameter across the two sides 430, 434 of the inlet pipe 414 and sides 432, 436 of the outlet pipe 416, define their respective cross-sectional areas. This is an important consideration for the flow of exhaust gases to, from, and through the present system 400, as discussed further below.

A first separator panel or baffle 438 has a first end 440 which is sealed to the inlet end plate 408 (or more properly, across the internal inlet plate 418, when the exhaust system 400 is so equipped) adjacent the second side 434 of the inlet pipe 414. This first separator panel 438 is sloped relative to the longitudinal axis of the system 400, and extends angularly through the majority of the length of the housing 402 toward the internal wall of the housing 402, where it terminates at its second end 442. The second end 442 of the first separator panel 438 is spaced away from the internal surface of the housing 402, and defines a cross-sectional area therebetween. This cross-sectional area is in the form of a circular segment, and is at least as great as (or greater than) the cross-sectional area of the inlet pipe 414.

A second separator panel 444 has a first end 446 which is sealed to the outlet end plate 410, or across the internal outlet plate 420 when the exhaust system 400 is so equipped, adjacent the first side 432 of the outlet pipe 416. The second separator panel 444 is also sloped relative to the longitudinal axis of the system 400, and extends angularly through the majority of the length of the housing 402 toward the internal wall of the housing 402, where it terminates at its second end 448. The two separator panels 438 and 444 are preferably substantially parallel to one another, and define an exhaust gas intermediate chamber 449 therebetween, as discussed further below. The second end 448 of the second separator panel 444 is also spaced away from the internal surface of the housing 402 and defines a cross-sectional area therebetween, essentially like the cross-sectional area between the second end 442 of the first separator panel 438 and the wall or housing 402 of the assembly 400. As in the case of the first separator panel 438, the cross-sectional area between the second end 448 of the second separator panel 444 is also at least as great as (or greater than) the cross-sectional areas of the inlet and outlet pipes 414 and 416.

Each of the two separator panels 438 and 444 includes a lateral exhaust gas pressure balance passage 450, which extends thereacross and near the respective first ends 440 and 446 of the two panels 438 and 444. These two pressure balance passages 450 provide alternative exhaust gas passages through the interior 412 of the system 400, with pressure pulses on each side of the panels 438 and 444 tending to cancel one another through the balance passages 450.

A first supplementary panel 452 has a first end 454 which is sealed across the internal surface of the inlet end plate 408 (or to its associated internal plate 418) adjacent the first side 430 of the inlet pipe 414, and extends angularly through substantially the first half of the length of the system 400. The outer edge of the supplementary panel 452 forms a parabolic curve, in keeping with its juncture with the cylindrical internal surface of the housing 402. It will be seen that the supplementary panel 452 may have any suitable peripheral shape adapted to mate closely with and seal along the internal surface of the housing 402, depending upon the shape of the housing 402. The first supplementary panel 452 is preferably parallel to the first separator panel 438, and along with the housing 402 walls, defines an exhaust gas inlet chamber 456 therebetween, as shown in the side elevation in section of FIG. 10.

A second supplementary panel 458 has a first end 460 sealed across the internal surface of the outlet end plate 410, or to its associated internal plate 420, adjacent the second side 436 of the outlet pipe 416, and extends angularly through substantially the second half of the length of the system 400. (The section line 11—11 in FIG. 10, is located at the center of the length of the device.) The outer edge of the second supplementary panel 458 is also sealed along the internal wall of the housing or shell 402, similarly to the first supplementary panel 452. The second supplementary panel 458 is preferably parallel to the second separator panel 444, and along with the housing 402 walls, defines an exhaust gas outlet chamber 462 therebetween.

The above described layout of the various panels or baffles 438, 444, 452, and 458 results in the inlet chamber 456, intermediate chamber 449, and outlet chamber 462 communicating with one another sequentially, as the exhaust gases flow from the inlet pipe 414 into the inlet chamber 456, through the gap between the second end 442 of the first separator panel 438 and the housing 402, back through the intermediate chamber 449, then through the gap between the second end 448 of the second separator panel 444 and the housing 402, through the outlet chamber 462, and finally out the outlet pipe 416. This sinusoidal primary exhaust gas pathway is at least two and one half times the external length of the system 400, due to the lengths of the two separator panels 438 and 444 extending within the housing 402 for some three quarters of the length of the housing 402, along with the additional internal entry and exit pipes (discussed further below) for the intermediate passage area 449.

The intermediate chamber 449 further includes a series of generally lateral baffles or vanes thereacross, which serve to further attenuate the sound of the exhaust as it passes through the present system 400. Intermediate chamber entry and exit baffles, respectively 464 and 466, extend laterally across the entry and exit ends of the intermediate passage area 449. These baffles extend completely across the interior of the housing 402, extending from the second end 442 of the first separator panel 438 to the second separator panel 444 (for the entry baffle 464) and from the second end 448 of the second separator panel 444 to the first separator panel 438 (for the exit baffle 466).

These two baffles 464 and 466 seal the intermediate passage area 449, with the exception of their passages 468 through which all exhaust gases must pass to travel into and from the intermediate chamber 449. Each internal baffle passage 468 may include a supplementary pipe extending therefrom, with the entry baffle 464 having an internal entry pipe 470 extending therefrom and toward the outlet end 406 of the system 400, and the exit baffle 466 having an exit pipe 472 extending therefrom and toward the inlet end 404 of the system 400. These two internal pipes 470 and 472 add some additional length to the intermediate chamber 449 for further tuning effect, and serve to duct and guide the exhaust gases into and from the intermediate chamber 449.

The intermediate chamber 449 further includes a series of generally chevron-shaped intermediate baffles or vanes extending between the two separator panels 438 and 444, and installed between the intermediate chamber entry and exit baffles 464 and 466. These baffles or vanes extend from a relatively wider first intermediate baffle 474 to a relatively narrower last intermediate baffle 476, with one or more secondary intermediate baffles 478 disposed therebetween. Each of these intermediate baffles 474 through 478 is oriented with the apex of the V facing the intermediate chamber entry baffle 464, and extends between the two separator panels 438 and 444. However, some lateral space is provided for exhaust gas flow around the ends of the intermediate baffles 474 through 478, with each of the baffles 474 through 478 having a narrower width from the entry baffle 464 toward the opposite exit baffle 466.

The orientation of the V-shaped intermediate baffles or vanes 474 through 488 results in the pressure pulses of the exhaust gases flowing through the intermediate chamber 449, flowing around the lateral edges of the baffles 474 through 478 and tending to cancel therebetween. The various sizes of baffles 474 through 478 results in the canceling of a relatively broad spectrum or frequency range of exhaust noise. The internal entry pipe 470, which passes through the passage 468 of the first or entry baffle 464, serves to guide the exhaust gases toward the first intermediate baffle or vane 474, with that baffle 474 dividing the gases therearound to either side thereof. The V-shape of the final or exit baffle 466, is opposite the orientation of the intermediate baffles 474 through 478 and serves to collect the exhaust energy flowing from the intermediate chamber 449 and direct it from that chamber 449 by means of the exit passage 468 therethrough (shown in FIG. 10) and internal exit pipe 472 extending therefrom.

It will be noted that the two supplementary panels 452 and 458, along with the adjacent areas of the external housing 402, define first and second supplementary volumes 480 and 482 in the device 400. The two supplementary panels 452 and 458 are provided with a series of perforations or passages 484 therethrough, which allow the pressure pulses of the exhaust gases to flow into the supplementary volumes 480 and 482, at least to some extent. This provides further frequency cancellation of exhaust noises and sounds in the present exhaust system 400. These passages 484 may be in the form of semicircular arcs, as shown, or some alternative shape as desired.

It will be further noted that many of the other various panels and components, e.g., the two internal pipes 470 and 472, may also be provided with a series of perforations or passages 484 therethrough. Similarly, the internal portions of the inlet and outlet pipes 414 and 416 may also be provided with such passages 484. These passages 484 serve to guide some portion of the exhaust flow into other areas of the system 400, thereby providing alternative flow paths for exhaust gases flowing through the present exhaust system 400. This further breaks up the gases and their pressure pulses, thus further attenuating such pressure pulses and the corresponding noise produced by such pressure pulses. The various areas of the present exhaust system 400 which do not experience a net flow of exhaust gases therethrough, e.g., the two supplementary volumes 480 and 482, may be filled with a sound absorbent material 428 such as glass fiber roving or matting, or other suitable material as desired, in the manner discussed further above for filling the end volumes 422 and 424 of the exhaust system 400.

The present exhaust system 400 may accomplish more than merely controlling the sound level of exhaust gases passing therethrough. Present technology incorporates separate catalytic converter elements for breaking down unburned hydrocarbons and oxides of nitrogen in exhaust gases. While the present system 400 does not provide the thorough processing of exhaust gases that a conventional catalytic converter does, the present system may still incorporate internal coatings 486 of emission reduction material therein if so desired, e.g., platinum, rhodium, palladium, etc.

The relatively free flow characteristics of the present exhaust system result in a relatively small percentage of the exhaust gases actually contacting the internal surfaces of the device 400. However, coating the internal surfaces with a catalytic conversion coating 486 as shown in FIG. 9, e.g., the internal surface of the housing 402, the separator panels 438 and 444, the supplementary panels 452 and 458, the entry, exit, and intermediate baffles or vanes 474 through 478, etc., nevertheless does provide some additional reduction in exhaust emissions. (Not all surfaces are shown with the coating detail, for clarity in the drawing FIG.) Moreover, the two end internal plates 418 and 420 may be made thicker to incorporate a significant amount of catalytically reactive material within their internal passages 426, and the internal construction may be modified to route substantially all of the gases through the end chambers 422 and 424, as noted further above. Thus, the present exhaust system 400 may accomplish essentially all of the required functions of exhaust treatment in a single device, i.e., muffling the overall sound level, resonating certain frequencies, and catalytically treating the exhaust emissions. Alternatively, one or more catalytic converters may be added to the exhaust system 400 if so desired, generally in the manner illustrated for the embodiments of FIGS. 17 and 18 and discussed further below.

FIGS. 10 and 11 illustrate another variation which may be incorporated with the present exhaust system 400. In FIGS. 10 and 11, an additional, secondary or outer shell 488 is provided, surrounding the inner shell of the housing 402 and defining a housing volume 490 therebetween. The volume 490 therebetween may be filled with sound absorbent material 428 to quiet the present exhaust system 400 further, and/or the inner shell may be perforated, if so desired.

FIGS. 12 through 16 provide perspective views of various alternative cross-sectional shapes which may be adapted for use with the present exhaust system invention. Such non-circular cross-sectional shapes may provide certain advantages in sound attenuation in comparison to a cylindrical unit, as noted above. In any event, the internal baffling and routing of the exhaust through any of the units illustrated in FIGS. 12 through 16, remains essentially the same as that illustrated for the cylindrical system 400 of FIGS. 8 through 11.

Figure 12:
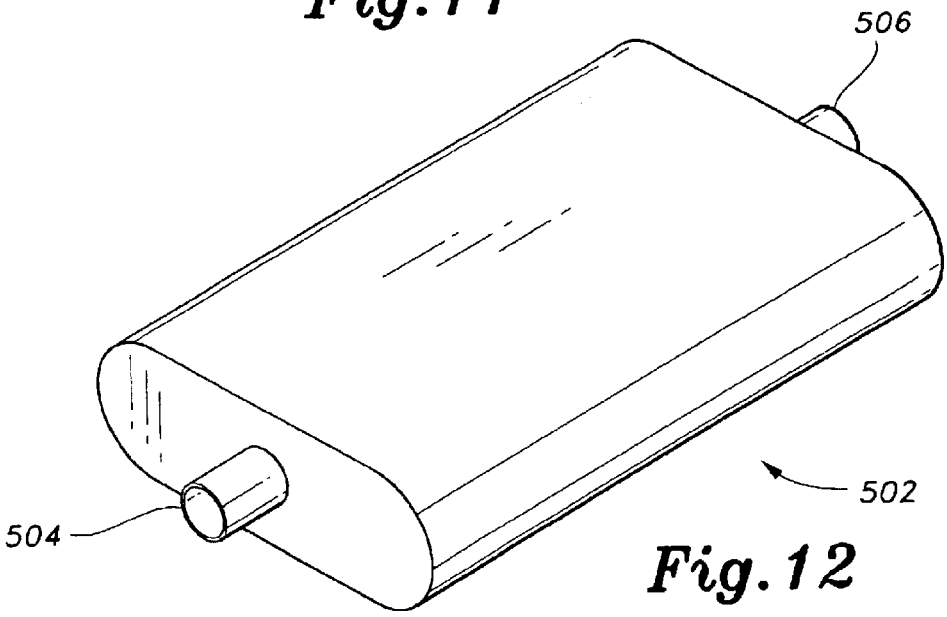
FIG. 12 is a perspective view of an alternative embodiment of the exhaust system of FIGS. 9 through 11, comprising an external shell having an oval cross-section.

In FIG. 12, an exhaust sound attenuation device 502 is illustrated, having a generally oval cross-section. It will be noted that the inlet pipe 504 and outlet pipe 506 are concentric with one another, and are aligned substantially with the center of the device, as is the case with the inlet and outlet pipes 414 and 416 of the exhaust system 400 of FIGS. 9 through 11. The separator and supplementary panels within the system 502 of FIG. 12 may be sloped or angled across the major dimension or width of the housing, with these panels and other baffles laterally spanning the narrower dimension of the device. Also, while the two ends of the oval system 502 are shown as being flat, it should be noted that convex end panels may be installed upon the exhaust device 502 of FIG. 12, if so desired, similarly to the convex end plates 408 and 410 of the exhaust system 400 of FIGS. 8 through 11. Internal plates, similar to the plates 418 and 420 of the system 400 of FIGS. 9 through 11, may be installed within such convex end plates, if so desired.

Figure 13:
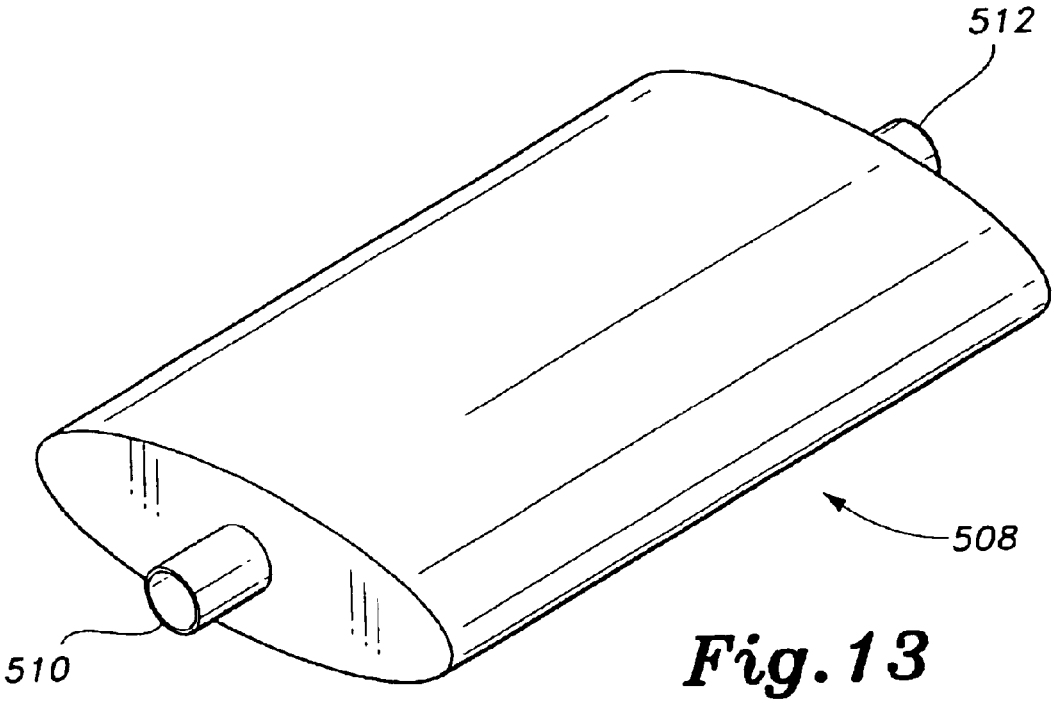
FIG. 13 is a perspective view of an alternative embodiment of the exhaust system of FIGS. 9 through 11, comprising an external shell having an elliptical cross-section.

FIG. 13 illustrates another embodiment of the present exhaust system, in which the exhaust sound attenuation device 508 has an elliptical cross-section. As in the case of the exhaust systems 400 and 502 of FIGS. 9 through 12, the exhaust system or device 508 includes an inlet pipe 510 and outlet pipe 512, which are aligned substantially concentrically with the center of the system. The elliptical cross-sectional shape of the exhaust system 508 of FIG. 13 is essentially a variation on the oval shape of the exhaust system 502 of FIG. 12, with internal components, end plates, etc. having the same configuration and alternative configurations.

Figure 14:
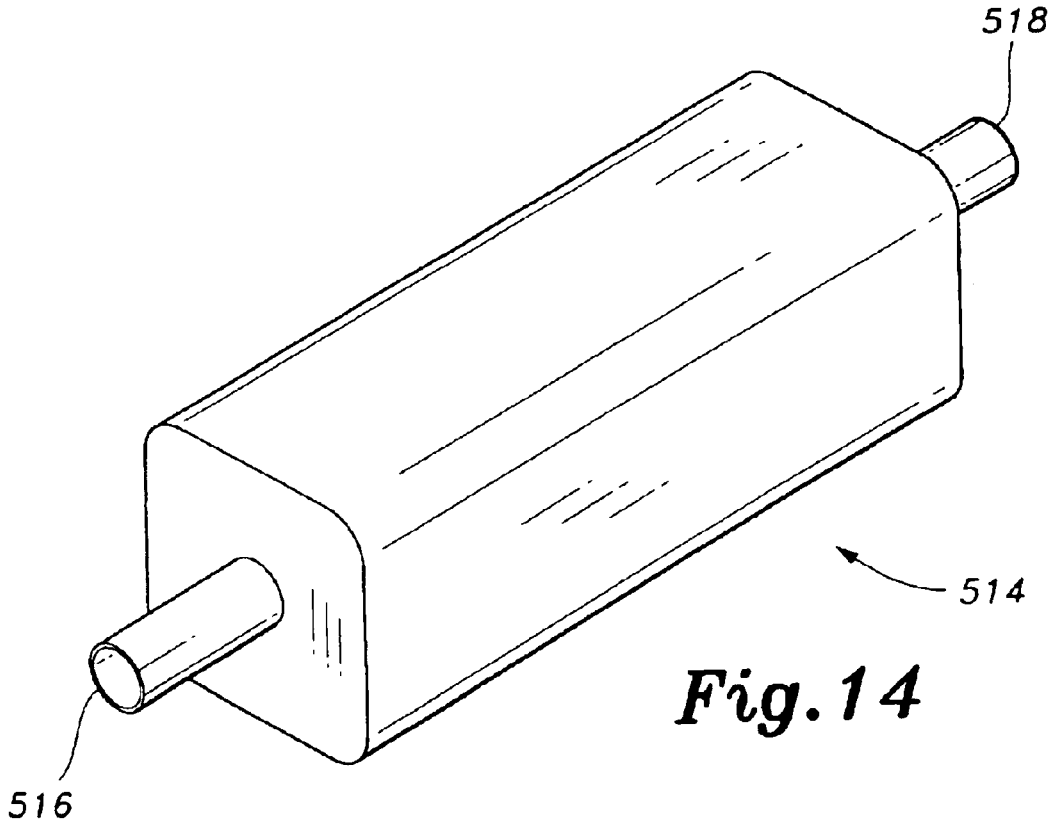
FIG. 14 is a perspective view of an alternative embodiment of the exhaust system of FIGS. 9 through 11, comprising an external shell having a rectangular cross-section.

FIG. 14 provides an illustration of yet another variation or embodiment of the present exhaust sound attenuation system, wherein the system 514 has a substantially square, or at least rectangular, cross-section. The exhaust system 514 may be either square or rectangular in cross-section, with it being recognized that these two shapes are essentially variations of one another, with the square shape shown for the device 514 of FIG. 14 being a special case in which the widths of each of the sides are identical to one another. Again, the inlet pipe 516 and outlet pipe 518 of the exhaust system 514 are substantially concentric with one another and with the main shell or housing of the device. The internal configuration of the exhaust system 514 is essentially the same as that illustrated for the cylindrical device 400 of FIGS. 9 through 11, with the widths of the various internal components being adjusted to fit the square or rectangular shape of the exhaust system 514 as required.

Figure 15:
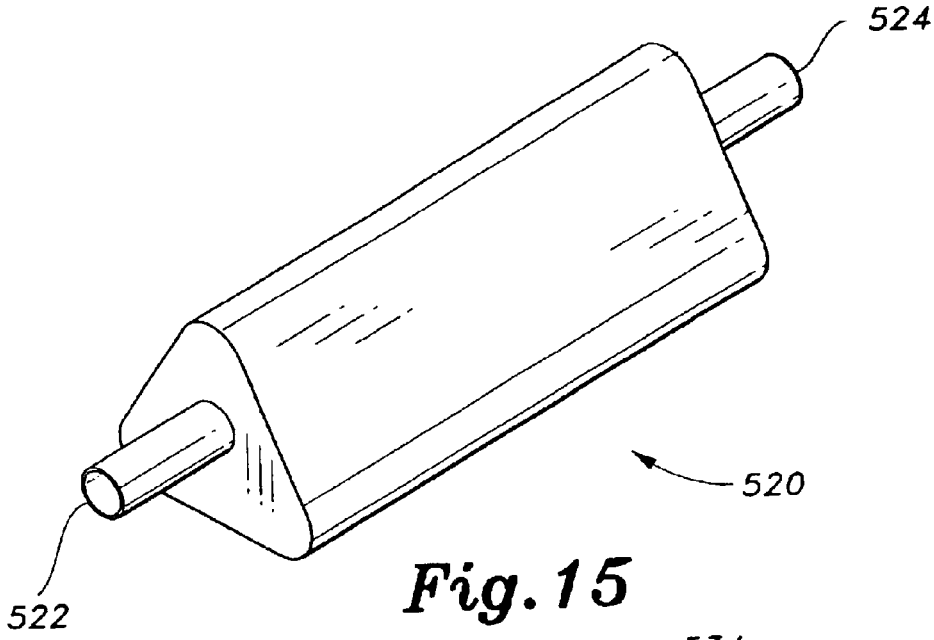
FIG. 15 is a perspective view of an alternative embodiment of the exhaust system of FIGS. 9 through 11, comprising an external shell having a triangular cross-section.

FIG. 15 illustrates still another embodiment of the present exhaust system invention, in which the device 520 has a generally triangular cross-section. As in the other embodiments of the present invention, the inlet and outlet pipes 522 and 524 may be installed concentrically with one another and with the main body or shell of the device. While a generally equilateral triangular shape is illustrated for the exhaust system 520 of FIG. 15, it will be seen that the cross-sectional shape may be flattened or altered to form an isosceles or other triangular shape as required to fit a given installation space.

Figure 16:
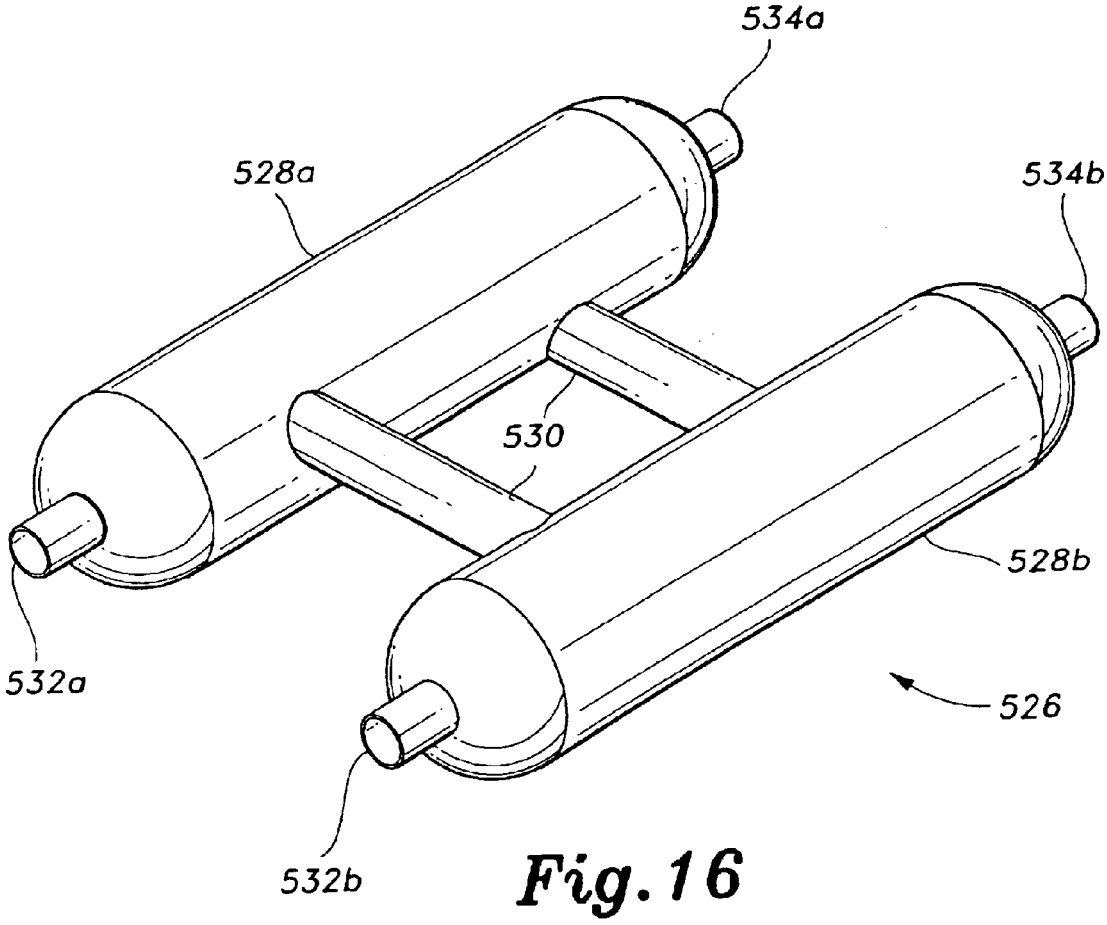
FIG. 16 is a perspective view of an alternative embodiment of the exhaust system of FIGS. 9 through 11, comprising two parallel devices joined by a pair of crossover pipes therebetween.

FIG. 16 illustrates an exhaust sound attenuation system embodiment 526 wherein two cylindrical units **528*a* and 528*b* are installed parallel to one another in a dual exhaust system. The two individual units 528*a* and 528*b* are interconnected by one or more crossover pipes 530, which allow exhaust gases to pass between the two units 528*a* and 528*b*. The dual system 526 is particularly useful in V-type engines, where each cylinder bank has its own individual exhaust system. Each individual system includes an inlet pipe, respectively 532*a* and 532*b* for the two units 528*a* and 528*b*, and an opposite outlet pipe, respectively 534*a* and 534*b* for the two units 528***a* and 528*b*. Each unit 528*a* and 528*b* is essentially similar to the cylindrical unit 400 illustrated in FIGS. 9 through 11, with the exception of the crossover pipes 530 which allow exhaust gases to communicate between the two units 528*a* and 528*a*. The interconnection of the two units 528*a* and 528*b* tends to balance the exhaust gas pulses flowing through either of the individual units 528*a* or 528*a*. It will be understood that the crossover pipes may connect between similar chambers or passages within the two units 528*a* and 528*b*, or may interconnect different chambers or passages between the two units, depending upon the desired effect. Also, while only two units 528*a* and 528*b* are illustrated in FIG. 16, it will be appreciated that the interconnection of similar or dissimilar chambers or passages between more than two units, using more than two crossover pipes, may be accomplished, if so desired.

To summarize the discussion of the second series of embodiments of FIGS. 9 through 16, the present exhaust sound attenuation and control system 400 provides numerous advantages over earlier systems of the prior art. The combination of muffler and resonator principles within a single exhaust sound attenuation device, provides significant benefits in packaging of such a system in the limited space available beneath a motor vehicle structure, or in other areas where space is critical. Moreover, the relatively compact nature of the present system provides benefits in terms of material, and therefore costs, during manufacture. The relatively small size and low material requirements, results in relatively light weight as well, which reduces shipping costs as well as reducing the overall weight of the motor vehicle or other powerplant with which the present exhaust system may be used.

The present exhaust system 400 provides further versatility, in that the internal components may be coated with catalytically reactive materials, in order to provide further cleaning of the exhaust gases passing therethrough. It has been noted in the present disclosure, that certain elements of the present system may be deepened or enlarged, and flow patterns revised, to provide exhaust emissions control on the order of that achieved by conventional catalytic converters. Yet, the free flow configuration of the present system, wherein each of the internal passages has a net cross-sectional area at least equal to (or perhaps greater than) the cross-sectional areas of the inlet pipe, provides good efficiency and assures that relatively low back pressures occur in the present system.

While conventional mufflers and resonators are constructed primarily of sheet metal, with various areas having corrosion resistant packing installed therein, it will be noted that the present system 400 is not limited to such materials. Relatively high temperature resistant synthetic materials (e.g., ceramics, carbon fiber, etc.) may be used in the construction of the present exhaust system 400, as desired. The material used is somewhat dependent upon the location of the present system 400 in the exhaust line of a vehicle or other installation. However, the present system 400 may be installed at virtually any location along the length of the system, with installations closer to the engine requiring greater heat resistance, but also providing greater catalytic reaction for a system providing such a feature. Where the installation may run somewhat cooler, the present system 400 may accept electrical or other heating means to increase the temperatures to levels where catalytic reactions are efficient.

The present exhaust system 400 also lends itself to installations on other than Otto cycle (four stroke, spark ignition) engines. Particulate traps may be added to contain carbon and other particles typically emitted by Diesel engines, if so desired. The system may also incorporate cooling chambers to control exhaust gas expansion, and therefore the sound output of such expanding gases. Other technology (e.g., electronic frequency canceling systems, etc.) may also be incorporated with the present exhaust system 400, as desired. Thus, the present exhaust system 400, even at its most basic level, provides significant improvements over the prior art.

Figure 17:
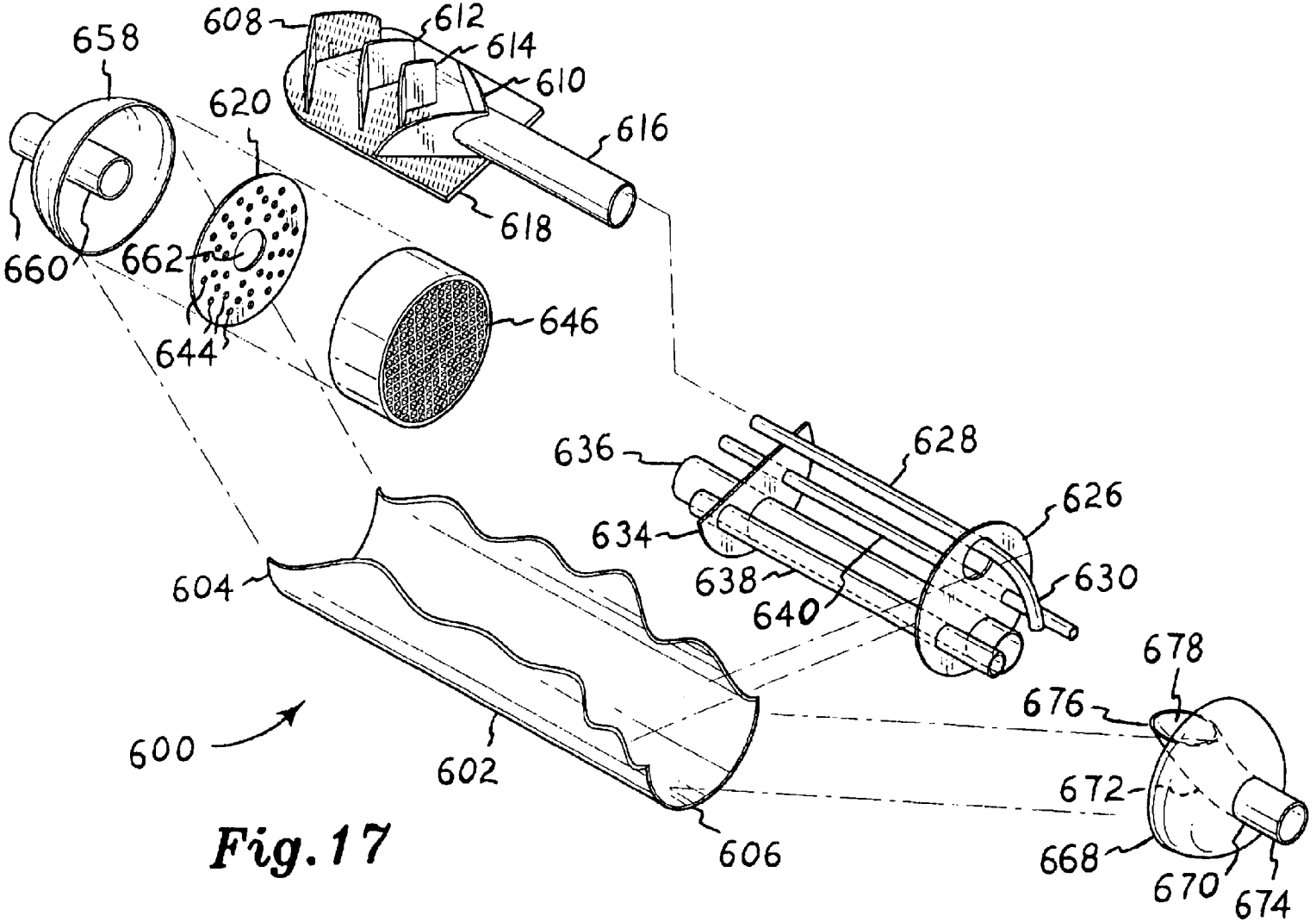
FIG. 17 is an exploded perspective view of another embodiment of the exhaust sound and emission control system of the present invention, illustrating an embodiment having a series of longitudinal tubes and catalytic converter element therein.
Figure 18:
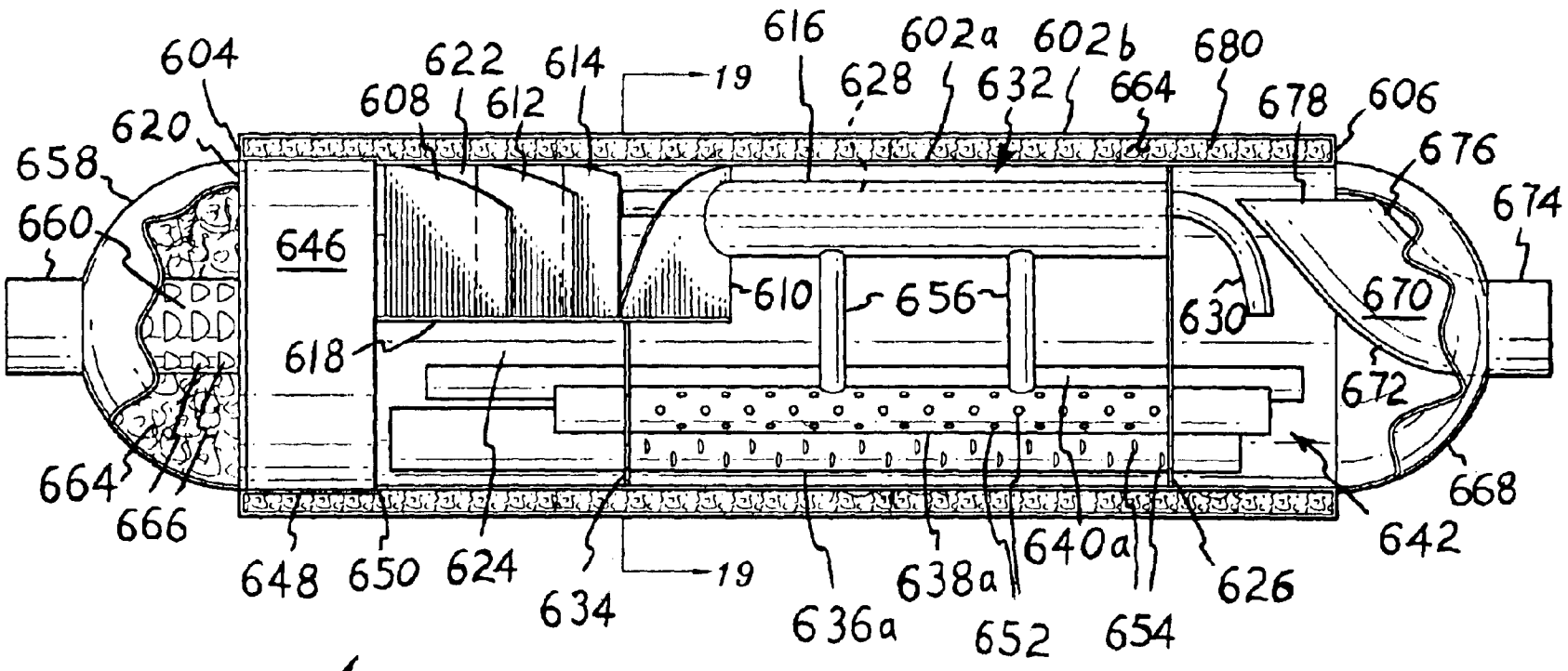
FIG. 18 is a side elevation view in section of an embodiment related to the device of FIG. 16, but incorporating a double wall external shell and other modifications.
Figure 19:
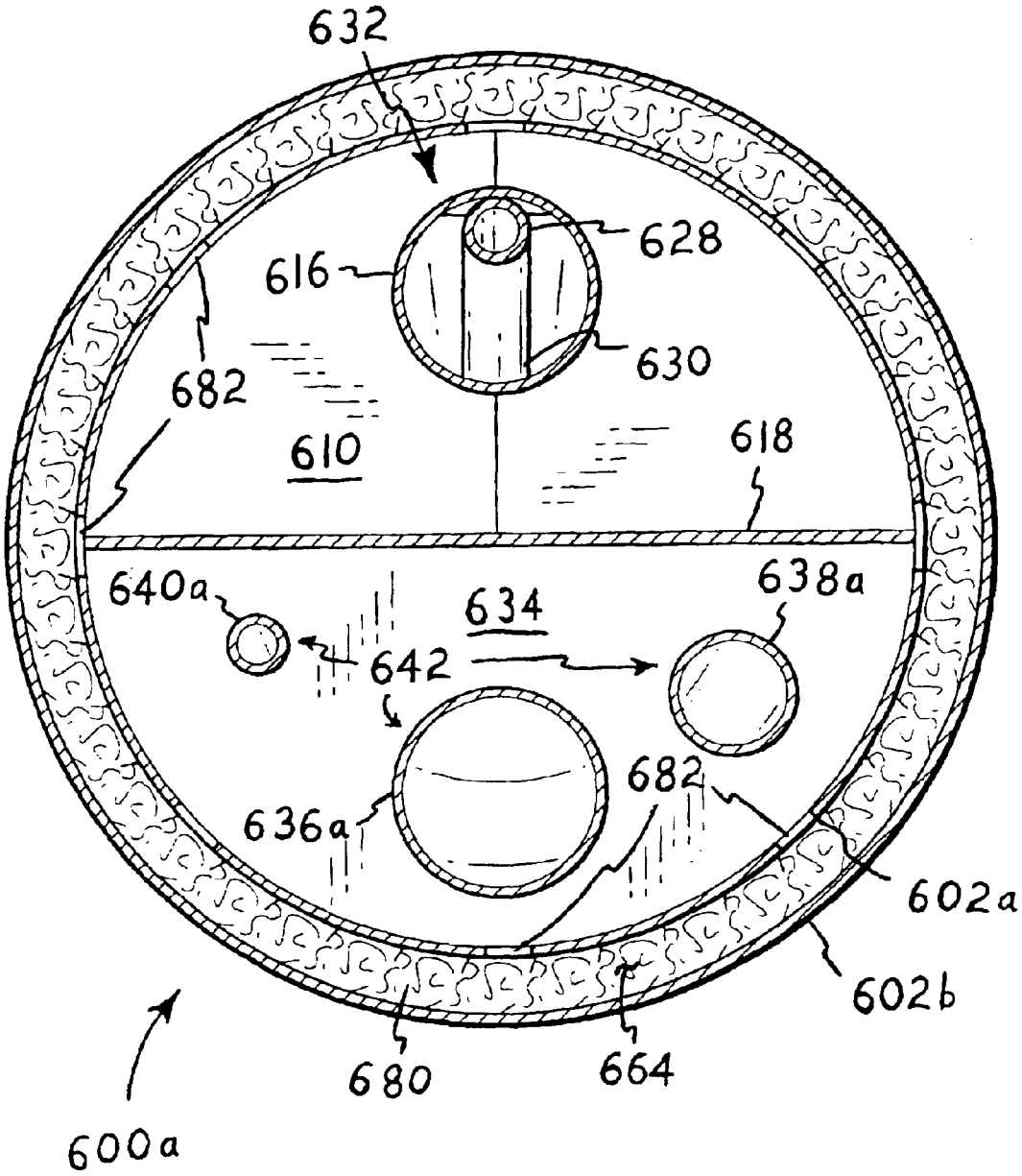
FIG. 19 is a cross section elevation view taken along line 19—19 of FIG. 18, showing further details of the device of FIG. 18.
Figure 20:
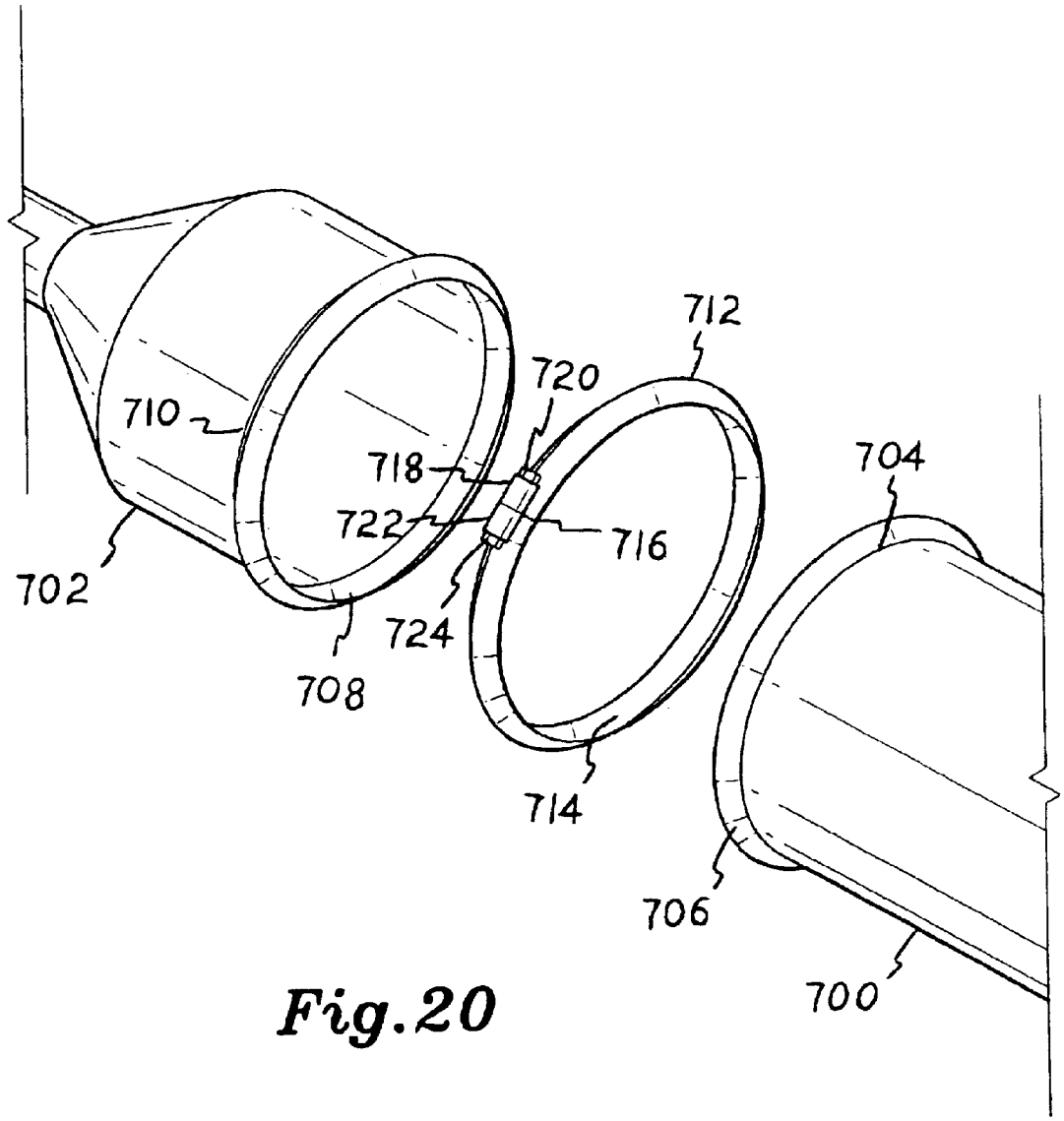
FIG. 20 is an exploded perspective view of an alternative embodiment which may be applied to any of the devices of the present invention, comprising a removable end component and clamp assembly.

FIGS. 17 through 19 illustrate a third series of embodiments of the present exhaust sound and emission control system, with FIG. 20 providing an illustration of a removable end component and clamp which may be applied to the embodiments of FIGS. 17 through 19, or to any of the other embodiments disclosed herein. The exhaust control device 600 of FIG. 17 includes a surrounding outer shell or housing 602 (shown only partially in FIG. 17, for clarity in the drawing FIG.) having a single or double wall (a single wall is shown in the embodiment of FIG. 17) with opposite exhaust inlet and exhaust outlet ends, respectively 604 and 606.

A series of spaced apart, generally V-shaped baffles or exhaust guide vanes, respectively 608 through 614, is installed within the housing 600 adjacent the exhaust inlet end 604. It will be noted that these baffles 608 through 614 are quite similar to the baffles 466 through 478 of the embodiment of FIGS. 9 through 11, and perform essentially the same function. The exhaust baffles comprise an entry baffle 608, an opposite exit baffle 610, and one or more intermediate baffles, e.g. first and second intermediate baffles 612 and 614. The entry baffle 608 and intermediate baffles 612 and 614 are oriented in the same direction, i.e. with their external apices toward the exhaust inlet end 604 of the assembly, with the exit baffle 610 oriented in the opposite direction to more efficiently collect exhaust gases and channel them to an exhaust passage tube 616 extending from the exit baffle 610.

It will be noted that the exhaust guide baffles 608 through 614 are mounted upon a baffle plate 618 and extend generally normal to the plate 618, to the interior of the housing wall 602.

The baffle plate 618 extends from an inlet end plate 620 within the inlet end 604 of the housing 602 (or from a catalytic converter element installed within the inlet end 604 of the device), and has a width extending laterally across the interior of the housing 602 to divide the inlet end portion of the housing 602 interior into a first inlet volume 622 and an opposite second inlet volume 624 (shown in the cross sectional view of FIG. 18). Exhaust gases entering the exhaust control device 600 are essentially split by the baffle plate 618 to pass into either the first inlet volume 622, around the baffles 608 through 614, and through the exhaust passage tube 616, or into the second inlet volume 624 on the opposite side of the baffle plate 618 from the first inlet volume 622 and its baffles 608 through 614.

An outlet end plate 626 is installed across the outlet end 606 of the housing 602, with the exit baffle 610 and outlet end plate 626 providing support for the opposite ends of the exhaust passage tube 616. The tube 616 has a relatively large diameter, and a smaller diameter secondary tube 628 is installed within the larger diameter tube 616. The secondary tube 628 may have an inwardly curved exit end 630, i.e. the end 630 is bent or curved toward the center of the housing 602, to provide a greater length than that of the surrounding tube 616. The exhaust passage tube 616 and secondary tube 628 contained therein comprise a first tube set 632, with their different lengths and diameters resulting in different resonant frequencies for the exhaust gas pulses passing therethrough with out of phase pulses canceling one another, as is known in the technology of exhaust resonators.

An intermediate support plate 634 extends across the downstream end of the second inlet volume 624 from the baffle plate 618, on the opposite side of the plate 618 from the exit baffle 610. The intermediate plate 634 and outlet end plate 626 provide support for the opposite ends of a series of substantially parallel, non-concentric exhaust passage tubes, e.g. tubes 636, 638, and 640. These tubes are all of different diameters and lengths from one another and are installed alongside one another in a longitudinal array within the housing 602 to form a second tube set 642, in order for exhaust gases passing therethrough to resonate at different frequencies for their pressure pulses to cancel one another. It will be appreciated that the tubes comprising the first and/or second tube sets 632 and 642 may be greater or fewer in number than those illustrated and described, and/or may have differing lengths, diameters, and/or positions than those shown, depending upon the range of frequencies to be affected by the present exhaust system 600.

Additional sound attenuation and gas flow may be achieved by providing additional holes, passages, and/or perforations through various internal components of the system. For example, the inlet end plate 620 may include a number of small perforations 644 therethrough, to allow better gas flow through the plate 620. This is especially important where a catalytic converter element 646 is installed in the upstream end 604 of the system. The efficiency of such a catalytic converter element 646 is dependent upon its internal surface area, with greater surface area providing better contact between exhaust gases flowing therethrough and the catalytically coated surfaces therein. Thus, a larger diameter and/or greater length for the catalytic element 646 is desirable, insofar as practicable. The catalytic element 646 of FIGS. 17 and 18 is accordingly formed to have a diameter essentially equal to that of the housing 602 (or 602*a*, in FIG. 18), with flow through the outer portions provided by the additional perforations 644 through the inlet end plate 620. It will be seen that the length of the housing 602 may be extended to provide room for a longer catalytic element therein, and/or multiple elements, as in the elements 124 and 126 of FIG. 3, may be provided for the exhaust device 600 and/or 600*a*, if so desired. The housing 602 (or 602*a*) preferably includes a slightly expanded section 648 to fit closely about the catalytic element 646, with a crimp 650 or slightly reduced section holding the element 646 in position at the exhaust entry end 604 of the housing.

Increased flow through the first and/or second tube sets 632 and/or 642 may also be provided by means of a series of perforations 652, slots 654, and/or other passages through the sides of the tubes. FIG. 18 illustrates such an alternative embodiment in the exhaust system 600*a*, where the tube 636*a* includes a number of slots 654 therethrough, with the tube 638*a* having a number of perforations 652 therethrough. While the perforated and slotted tubes 638*a* and 636*a* are contained within the second tube set 642, it will be seen that such perforations, slots, and/or other exhaust gas passages may be formed through any of the tubes of the first set 632 and/or second set 642, depending upon the desired gas flow and frequencies to be affected.

Another means of affecting the gas flow and sound qualities of the exhaust system 600 (or 600*a*) is by interconnecting various tubes of the first and/or second tube sets 632 and/or 642. The exhaust system embodiment 600*a* illustrated in FIG. 17, shows such an interconnection. The system 600*a* includes a pair of gas flow crossover lines 656 extending between the larger diameter exhaust passage tube 616 of the first tube set 632 and the perforated tube 638*a* of the second tube set 642. As in the tube lengths, diameters, perforations, and positions, the number, diameter, and/or locations of the crossover lines 656 may be adjusted as desired to affect the final result.

The two ends of the housing 602 or 602*a* are sealed, in order to contain all exhaust gases within the system. The inlet end of the system includes an inlet cap 658 thereon, which may have a hemispherical shape as shown, or other shape (e.g., conical, etc.) as desired. An inlet pipe 660 passes through the inlet cap 658 and may pass through a central hole 662 in the inlet end plate 620, to deliver exhaust gases to the interior of the housing. The volume between the inlet end cap 660 and inlet end plate 620 may be filled with an acoustic insulation material 664, if so desired, with the portion of the inlet pipe 660 between the inlet end cap 660 and inlet end plate 620 having a series of slots or louvers 666, or other perforations or exhaust passages therethrough, in order to further dampen exhaust gas pulses as they enter the system.

The opposite exhaust gas outlet end of the system includes an outlet end cap 668, which may be hemispherically shaped or may have any other shape as practicable. The outlet cap 668 is sealed to the outlet end 606 of the housing 602 (or 602*a*), and includes an exhaust outlet collector tube 670 extending therethrough. The collector tube 670 includes a medial portion 672 which passes through a passage in the outlet cap 668, an exterior end 674 extending outwardly past the outlet cap 668 with an opening for connecting to the downstream portion of the exhaust system, and an opposite interior end 676 with an opening 678 therein. The interior end 676 of the collector tube 670 may be curved or bent toward the wall of the housing 602 (or 602*a*), with its interior end opening 678 beveled so as to be positioned closely adjacent and parallel to the housing wall 602 or 602*a*. This affects the outflow of exhaust gases from the system, further dampening and attenuating exhaust noise.

The alternate embodiment 600*a* of FIGS. 18 and 19 includes other features which differ from the embodiment 600 of FIG. 17, in addition to the perforations shown in the second pipe set 642. It will be noted that the exhaust system 600*a* includes a double wall housing, comprising an inner wall 602*a* and an outer wall 602*b*. The two walls 602*a* and 602*b* are generally concentric and spaced apart from one another, and define an acoustic insulation volume 680 therebetween. Acoustic insulation material 664, essentially the same as the material 664 placed within the volume between the inlet end cap 658 and the inlet end plate 620, may be installed within the volume 680 between the two walls 602*a* and 602*b*. Moreover, the interior wall 602*a* may optionally include a series of perforations or passages 682 therein (illustrated in FIG. 19), to allow exhaust gas pulses to be absorbed directly into the acoustic material 664 between the two walls 602*a* and 602*b*.

Prototypes have been constructed of the present exhaust system 400 of FIGS. 9 through 11, as well as the system 600 of FIGS. 17 through 19, and tested upon a series of different automobiles having different engines. A table showing the results of this testing, is provided below.

TABLE II

| | TEST RESULTS | | | |
|---|---|---|---|---|
| SYSTEM TYPE | LENGTH | DIAMETER | IDLE dB | HIGH RPM dB |
| FEDERAL STANDARDS (STANDARD VEHICLE) | N/A | N/A | 79–85 | |
| FEDERAL STANDARDS (HIGH PERFORMANCE VEHICLE) | N/A | N/A | 85–98 | |
| FORD 4.6 L ENGINE, OPEN EXHAUST | N/A | N/A | 85–87 | |
| FORD 4.6 L ENGINE, W/RESONATOR AND MUFFLER Rect. unitary assembly | 23 in. | 10.5" × 6" | 70–73 | 88 |
| FORD 3.0 L ENGINE, W/ RESONATOR AND MUFFLER Round res. w/separate oval muffler | 23 in. | 10.5" × 6" | 71–73 | |
| TENNECO ULTRA FLOW MUFFLER | 30 in. | 6 in. | 73–75 | |
| SYSTEM OF FIG. 9 (WITHOUT INTERNAL PACKING INSULATION), TESTED ON FORD 4.6 L ENGINE | 22.5" | 6 in. | 74–75 | 88 |
| SYSTEM OF FIG. 10 (WITH INTERNAL PACKING INSULATION), TESTED ON FORD 4.6 L ENGINE | 22.5" | 6 in. | 71–73 | 88 |
| SYSTEM OF FIG. 17 (WITHOUT INTERNAL PACKING INSULATION), TESTED ON FORD 4.6 L ENGINE | 22.5" | 4 in. | 73–75 | 90 |
| SYSTEM OF FIG. 18 (WITH INTERNAL PACKING INSULATION), TESTED ON FORD 4.6 L ENGINE | 22.5" | 4 in. | 73–75 | 90 |

The above test results indicate that various embodiments of the present exhaust system, which combine features of both a muffler and a resonator within a single unit, result in a considerably more compact sound attenuation device than the mufflers and resonators of the earlier art, while still quieting exhaust output to essentially the same levels. The prior art systems range from 23 to 30 inches in length, with diameters or widths from 6 to 10.5 inches. The length and diameter of the system illustrated herein in FIGS. 9 through 19, are equal to or slightly less than the smallest dimensions of any of the units of the prior art listed in the table above. The smaller overall size of the present unit equates to less material used in construction, and thus lower cost for the present exhaust system in comparison to earlier units. Moreover, the smaller size makes the present system easier to "package" in an automotive installation, providing engineers with greater freedom in designing exhaust installations in automobiles (and/or other reciprocating engine installations to which the present system may be adapted).

Conventional thought in the industry is that the shape of an exhaust system (muffler and resonator) are important to the sound attenuating qualities of the system, with all other factors being equal. Units having oval, rectangular, or other non-circular cross sections, generally attenuate noise better than round systems. Yet, the industry is tending toward round exhaust systems, in order to save packaging space during installation. The present system provides sound attenuation equal to that of larger, non-circular systems, in a small, compact, circular cross section system.

Another variation which may be applied to any of the exhaust devices or systems of the present invention, is a removable exhaust inlet or outlet end for accessing internal components for maintenance and/or replacement thereof, e.g., for replacement of a contaminated catalytic converter element. FIG. 20 illustrates such a configuration. In FIG. 20, an exhaust system has a separate housing or shell 700 and end cap 702. The end cap 702 may comprise an exhaust inlet end or an exhaust outlet end, or both may be installed on the same shell 700, if so desired. The end 704 of the housing or shell 700 to which the removable cap 702 is to be applied, is provided with a radial, outwardly extending flange 706. The end cap 702 includes a radially disposed peripheral bead 708 formed about its edge 710, with the flange 706 of the shell 700 configured to fit closely about the bead 708 of the end cap 702. While a conical flange 706 is shown extending from the end 704 of the housing or shell 700 and a V-section bead is shown extending from the edge of the end cap 702 in FIG. 20, it will be appreciated that a wide range of different flange and bead shapes may be used, e.g. round, oval, etc. as desired, so long as the flange and bead have closely mating shapes.

A split ring 712 is provided with an internal channel 714 having a shape which fits closely about the bead 708 of the end cap 70s and the flange 706 of the housing or shell 700 when they are assembled with one another. The ring 712 is discontinuous, and may be opened at a break or split 716 therein. A clamp extends from the ring 712 at the split 716, with one side of the clamp comprising a generally tangential first sleeve 718 for a bolt 720, and the opposite side of the clamp comprising a mating, generally tangential second sleeve 722. The second sleeve 722 is coaxial with the first sleeve 718 when the ring 712 is assembled upon the mating bead 708 and flange 706 of the assembled end cap 702 and housing 700, with the bolt 720 passing through the two sleeves 718 and 722 to be secured by a nut 724 opposite the head of the bolt 720. Alternatively, the second sleeve 722 may be threaded, in order to eliminate the requirement for the nut 724.

It will be seen that alternative means may be used for securing the housing 700 and end cap 702 together, e.g. mating flanges extending from each component with separate rings installed on each component to sandwich the flanges together, and secured by peripherally disposed bolts through the flanges. Another alternative would be to widen the flanges sufficiently to form bolt holes therein, and secure the two flanges directly by means of a series of bolts therethrough. Other means of securing the two components together may be provided as desired. As noted further above, the above described removable end component illustrated in FIG. 20 may be applied to either the exhaust inlet end of the assembly, or to the exhaust outlet end, or to both ends, as desired. It will also be noted that the removable end assembly illustrated in FIG. 20 is not limited to the embodiments illustrated in FIGS. 17 through 19, but may be applied to any of the exhaust system embodiment described and illustrated herein. Where an exhaust device having a non-circular cross section is provided, the shape of the split ring may be formed to conform with the non-circular shape as required.

In conclusion, the present exhaust system embodiments provide significant improvements in packaging, manufacturing costs, and installation time and labor, by combining a number of heretofore separate and distinct exhaust system components into a single device. The present exhaust sound and emission control systems may be provided in any one of a number of different embodiments, with various features of each embodiment capable of being adapted to any of the other embodiments, where practicable. For example, FIGS. 4 and 5 illustrate catalytic converter and resonator assemblies having two side-by-side resonator sections. Such a configuration may be adapted to any of the generally cylindrical, single muffler and/or catalytic converter configurations shown in other embodiments, e.g., the embodiments of FIGS. 9 through 11 and 17 through 19. Similarly, the present invention need not be constructed to have a cylindrical shape, as shown by the various alternative illustrated in FIGS. 12 through 16. These various non-circular configurations may be adapted to any of the other embodiments shown and described herein, including the double system having external crossover pipes illustrated in FIG. 16. The versatility of the present exhaust system provides widespread application to innumerable motor vehicles and other uses, and will prove quite valuable in reducing both exhaust system noise and emissions.

It is to be understood that the present invention is not limited to the embodiments described above, but encompasses any and all embodiments within the scope of the following claims.

I claim:

1. An exhaust sound and emission control system, comprising:

a housing wall, an exhaust inlet end, and an exhaust outlet end opposite said exhaust inlet end;

a plurality of spaced apart, generally V-shaped guides disposed within said housing adjacent said exhaust inlet end thereof; and a plurality of generally parallel, non-concentric tubes dispose longitudinally within said housing, beside one another;

wherein said tubes are of different diameters and lengths from one another.

2. The exhaust sound and emission control system according to claim 1, further including:

an inlet end plate disposed within said exhaust inlet end of said housing;

an outlet end plate disposed within said exhaust outlet end of said housing;

a baffle plate disposed longitudinally within said housing, extending from said inlet end plate and laterally across said housing wall, defining a first inlet volume and a second inlet volume;

said V-shaped guides extending across said first inlet volume from said baffle plate to said housing wall, and normal thereto;

a first tube set extending from said v-shaped guides to said outlet end plate; and a second tube set extending from said second inlet volume to said outlet end plate.

3. The exhaust sound and emission control system according to claim 2, wherein at least said inlet end plate further includes a plurality of perforations therethrough.

4. The exhaust sound and emission control system according to claim 2, wherein said first tube set comprises at least a first tube surrounding a second tube.

5. The exhaust sound and emission control system according to claim 2, further including at least one gas flow crossover line connecting at least one of said tubes of said first tube set with at least one of said tubes of said second tube set.

6. The exhaust sound and emission control system according to claim 1, wherein said tubes further include a plurality of perforations therethrough.

7. The exhaust sound and emission control system according to claim 1, further including:

an exhaust outlet collector tube having an interior end with an interior end opening, a medial portion, and an exterior end opposite said interior end, with said medial portion disposed through said exhaust outlet end of said housing; and said interior end of said exhaust outlet collector tube being curved, with said interior end opening being beveled and positioned adjacent and generally parallel to said housing wall.

8. The exhaust sound and emission control system according to claim 1, further including at least one catalytic converter element disposed within said inlet end of said housing.

9. The exhaust sound and emission control system according to claim 1, further including a plurality of catalytic converter elements disposed within said inlet end of said housing.

10. The exhaust sound and emission control system according to claim 1, wherein said housing further comprises:

an outer wall; and an inner wall spaced from said outer wall, and defining an acoustic insulation volume therebetween.

11. The exhaust sound and emission control system according to claim 10, further including acoustic insulation material disposed within said acoustic insulation volume between said outer wall and said inner wall.

12. The exhaust sound and emission control system according to claim 1, further including a removable exhaust inlet end attachment fitting, removably securing said exhaust inlet end to said housing.

13. The exhaust sound and emission control system according to claim 1, further including removable exhaust inlet end and exhaust outlet end attachment fittings, respectively removably securing said exhaust inlet end and said exhaust outlet end to said housing.

14. An exhaust sound and emission control system, comprising:

a canister for installing in the exhaust system of an internal combustion engine, with said canister including an inlet end, a forward portion adjacent said inlet end, a rearward portion adjacent said forward portion, an outlet end adjacent said rearward portion, a forward inner diameter, and a rearward inner diameter;

at least one catalytic converter element installed within said forward portion of said canister, with said catalytic converter element having an outer diameter and including a substrate having a plurality of longitudinal passages therethrough, with each of said passages being defined by a plurality of substrate walls;

a resonator element installed within said rearward portion of said canister, with said resonator element having a hollow core, a forward end, a rearward end, an outer diameter, length defined between said forward end and said rearward end, and a plurality of sound attenuating perforations formed radially therethrough;

said sound attenuating perforations being distributed along the length of said resonator element between said forward end and said rearward end;

said forward end defining a forward element inner diameter, and said rearward end defining a rearward element inner diameter;

wherein said forward element inner diameter and said rearward element inner diameter being equal;

said outer diameter of said resonator element being smaller than said rearward inner diameter of said canister, and defining a sound attenuating plenum therebetween;

said inlet end of said canister, said plurality of passages of said catalytic converter element, said hollow core of said resonator element, and said outlet end of said canister all being axially aligned with one another for providing straight through, low restriction, free flow engine exhaust therethrough; and at least one removable end attachment fitting, removably securing at least said inlet end to said canister;

whereby the exhaust gases flow unimpeded through said catalytic converter and said resonator element within said canister.

15. The exhaust sound and emission control system according to claim 14, wherein said canister further comprises:

an outer wall;

an inner wall spaced from said outer wall, and defining an acoustic insulation volume therebetween; and acoustic insulation material disposed within said acoustic insulation volume between said outer wall and said inner wall.

16. An exhaust sound and emission control system, comprising:

an elongate external housing, having an inlet end and an outlet end opposite said inlet end;

an inlet end plate and an outlet end plate, respectively secure to and sealing said inlet end and said outlet end of said housing and defining an interior volume therein;

an inlet pipe and an outlet pipe, respectively extending from said inlet end plate and from said outlet end plate, and communicating with said interior volume;

an inlet chamber, an intermediate chamber, and an outlet chamber disposed within said housing, respectively communicating with one another sequentially from said inlet pipe to said outlet pipe and defining a sinusoidal primary exhaust gas passage therethrough;

a first separator panel separating said inlet chamber from said intermediate chamber;

a second separator panel separating said intermediate chamber from said outlet chamber said first separator panel and said second separator panel each including a lateral exhaust gas pressure balance passage therethrough, with each said pressure balance passage defining an alternative gas passage path through said interior volume; and at least one catalytic converter element disposed within said inlet end of said housing.

17. The exhaust sound and emission control system according to claim 16, further including a plurality of catalytic converter elements disposed within said inlet end of said housing.

18. The exhaust sound and emission control system according to claim 16, further including at least one removable end attachment fitting, removably securing at least said inlet end to said housing.

19. An exhaust sound and emission control system, comprising:

a housing having a housing wall, an exhaust inlet end, and an exhaust outlet end opposite said exhaust inlet end;

a plurality of spaced apart, generally V-shaped guides disposed within said housing, adjacent said exhaust inlet end thereof;

a plurality of generally parallel, non-concentric tubes disposed longitudinally within said housing, beside one another; and at least one gas flow crossover line connecting at least one of said tubes with another of said tubes.

* * * * *